US007127189B2

(12) United States Patent
Takamatsu et al.

(10) Patent No.: US 7,127,189 B2
(45) Date of Patent: Oct. 24, 2006

(54) HEATING UNIT, AUXILIARY POWER UNIT, FIXING UNIT, AND IMAGE FORMING APPARATUS

(75) Inventors: Ryo Takamatsu, Tokyo (JP); Naoki Sato, Tokyo (JP); Yuusuke Ishizaki, Tokyo (JP); Hiroto Ohishi, Tokyo (JP); Masahide Nakaya, Tokyo (JP); Keiichi Sugai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 154 days.

(21) Appl. No.: 11/006,693

(22) Filed: Dec. 8, 2004

(65) Prior Publication Data

US 2005/0139591 A1 Jun. 30, 2005

(30) Foreign Application Priority Data

Dec. 8, 2003 (JP) ..... 2003-409019
Jan. 29, 2004 (JP) ..... 2004-021043
Feb. 3, 2004 (JP) ..... 2004-026680

(51) Int. Cl.
*G03G 15/20* (2006.01)

(52) U.S. Cl. ..... 399/69; 369/89; 315/112; 315/116; 345/212

(58) Field of Classification Search ..... 399/69, 399/88, 89; 315/115–117, 112, 106; 345/211–213; 323/366, 370, 282; 363/88, 97
See application file for complete search history.

(56) References Cited

U.S. PATENT DOCUMENTS 4,980,811 A * 12/1990 Suzuji et al. ..... 363/21.07
6,278,103 B1 * 8/2001 Takami ..... 250/214 R
6,346,800 B1 * 2/2002 Mano et al. ..... 323/282
6,741,239 B1 * 5/2004 Iwasaki ..... 345/211

FOREIGN PATENT DOCUMENTS

JP 2000-315567 11/2000
JP 2002-304088 10/2002
JP 2002-357966 12/2002
JP 2003-140484 5/2003

* cited by examiner

*Primary Examiner*—Haissa Philogene
(74) *Attorney, Agent, or Firm*—Oblon, Spivak, McClelland, Maier & Neustadt, P.C.

(57) ABSTRACT

A main controller controls a capacitor charger to charge a capacitor as necessary. A sub-controller controls a power saving mode and stops a power supply to the main controller when shifting to the power saving mode. A charge control circuit compares a terminal voltage of the capacitor with a predetermined value by a comparator circuit. If the terminal voltage is lower than the reference value, an AND circuit takes a logical product of an output signal of the comparator circuit and a power saving signal indicating the shift to the power saving mode, and outputs a control signal indicating an instruction to charge the capacitor, to the capacitor charger.

36 Claims, 30 Drawing Sheets

HEATING UNIT, AUXILIARY POWER UNIT, FIXING UNIT, AND IMAGE FORMING APPARATUS

CROSS-REFERENCE TO RELATED APPLICATIONS

The present document incorporates by reference the entire contents of Japanese priority documents, 2003-409019 filed in Japan on Dec. 8, 2003, 2004-021043 filed in Japan on Jan. 29, 2004, and 2004-026680 filed in Japan on Feb. 3, 2004.

BACKGROUND OF THE INVENTION

1) Field of the Invention

The present invention relates to a heating unit and a fixing unit that include a heating member that produces heat with charging of a capacitor, an auxiliary power unit and a fixing unit that include a plurality of capacitors serially connected to each other, and an image forming apparatus including the above fixing unit.

2) Description of the Related Art

Japanese Patent Application Laid Open No. 2000-315567, Japanese Patent Application Laid Open No. 2002-357966, and Japanese Patent Application Laid Open No. 2003-140484 disclose technologies for a heating member (fixing heater) of a fixing unit used in an electrophotographic image forming apparatus. This technology is such that in addition to a power supply from a commercial power supply, a chargeable auxiliary power supply that uses an electric double layer capacitor is used to allow fast rising of temperature and enhance effects of power saving.

Electrophotographic image forming apparatuses and other electronic devices including a power saving mode are known. In the power saving mode, when the electrophotographic image forming apparatus or the like is in a standby state and is not used for a fixed time, a power supply to power loads thereof is restricted and the power is supplied only to some circuits minimum required to allow power saving and energy saving. One of these is disclosed in Japanese Patent Application Laid Open No. 2002-304088.

In the electrophotographic image forming apparatus, if temperature of a fixing unit is made to rise quickly by the chargeable auxiliary power supply using the capacitor such as the electric double layer capacitor, the power of the capacitor if it is low cannot increase the fixing temperature quickly. Therefore, when the charging power of the capacitor decreases to a predetermined level or less, a specified controller needs to control a charger so as to charge the capacitor.

However, in such an image forming apparatus as explained above that includes the power saving mode, if a power supply to the controller (e.g. microcomputer) that controls the charger so as to charge the capacitor is also stopped when mode shifts to the power saving mode, the capacitor is not charged in the power saving mode. In this case, if the amount of charge in the capacitor decreases to a quite low level right before shifting to the power saving mode, or if the power saving mode is active for a long time and natural discharge of the capacitor occurs, the charge amount of the capacitor is insufficient by the time it is returned from the power saving mode, which makes it impossible to quickly increase the fixing temperature of the fixing unit.

In such a case, it is possible to rapidly increase the fixing temperature by maintaining the power supply to the controller even after the shift to the power saving mode.

However, the controller also consumes power even in the power saving mode, which is quite difficult to achieve satisfactory power saving and energy saving.

In the technologies disclosed in Japanese Patent Application Laid Open No. 2000-315567, Japanese Patent Application Laid Open No. 2002-357966, and Japanese Patent Application Laid Open No. 2003-140484, by using the capacitor including the electric double layer capacitor (large capacitor) as an auxiliary power supply, degradation of fixability due to power failure can be prevented. That is because a large amount of current can be instantly supplied from the capacitor to the fixing unit when the power supply to the fixing unit from the commercial power supply is insufficient. However, the technologies have such inconvenience that the capacitor has to be charged at a predetermined timing after the capacitor discharges to supply power to the heating member. Moreover, since a large amount of power has to be supplied from the commercial power supply during the charging, a copying operation cannot concurrently be executed by a copying machine, which causes a down time to occur in the copying machine and the operability of a user to be reduced.

SUMMARY OF THE INVENTION

It is an object of the present invention to solve at least the above problems in the conventional technology.

A heating unit according to one aspect of the present invention includes a capacitor; a charger that charges the capacitor; a heating member that produces heat with a supply of a charging power from the capacitor; a terminal-voltage detecting circuit that detects a terminal voltage of the capacitor; a control unit that controls the charger based on the terminal voltage detected to charge the capacitor; a power controller that stops, when a predetermined condition is satisfied, a power supply to a part of power loads of the heating unit including the control unit, and releases, when a predetermined condition is satisfied during a stop state of the power supply, the stop state; and a charge controller that controls, during the stop state of the power supply, the charger to charge the capacitor based on the terminal voltage detected.

A fixing unit according to another aspect of the present invention includes a fixing member that applies pressure and heat to a medium, on which a toner image is formed, to fix the toner image on the medium; a capacitor; a charger that charges the capacitor with a supply of power from a commercial power supply; a heating member that produces heat with a supply of charging power from the capacitor; a terminal-voltage detecting circuit that detects a terminal voltage of the capacitor; a control unit that controls the charger based on the terminal voltage detected to charge the capacitor; a power controller that stops, when a predetermined condition is satisfied, a power supply to a part of power loads of the heating unit including the control unit, and releases, when a predetermined condition is satisfied during a stop state of the power supply, the stop state; and a charge controller that controls, during the stop state of the power supply, the charger to charge the capacitor based on the terminal voltage detected.

An image forming apparatus according to still another aspect of the present invention, which forms an image on a medium using an electrophotographic method, includes a fixing unit including a fixing member that applies pressure and heat to a medium, on which a toner image is formed, to fix the toner image on the medium; a capacitor; a charger that charges the capacitor with a supply of power from a commercial power supply; a heating member that produces heat with a supply of charging power from the capacitor; a terminal-voltage detecting circuit that detects a terminal voltage of the capacitor; a control unit that controls the charger based on the terminal voltage detected to charge the capacitor; a power controller that stops, when a predetermined condition is satisfied, a power supply to a part of power loads of the heating unit including the control unit, and releases, when a predetermined condition is satisfied during a stop state of the power supply, the stop state; and a charge controller that controls, during the stop state of the power supply, the charger to charge the capacitor based on the terminal voltage detected.

A heating unit according to still another aspect of the present invention includes a capacitor; a charger that charges the capacitor; a heating member; a discharger that discharges charging power of the capacitor to the heating member to make the heating member produce heat; a first control unit that stops, when a predetermined condition is satisfied, a power supply to other power loads except for a part of power loads of the heating unit, and releases, when the predetermined condition is satisfied during a stop state of the power supply, the stop state; and a second control unit that is driven with a supply of power independently from the first control unit, and controls charging of the capacitor.

A fixing unit according to still another aspect of the present invention includes a fixing member that applies pressure and heat to a medium, on which a toner image is formed, to fix the toner image on the medium; a first heating member that produces heat with a supply of power from a commercial power supply, and heats the fixing member; a capacitor; a charger that charges the capacitor with a supply of power from the commercial power supply; a second heating member that produces heat with a supply of power from the capacitor, and heats the fixing member; a first control unit that stops, when a predetermined condition is satisfied, a power supply to other power loads except for a part of power loads of the heating unit, and releases, when the predetermined condition is satisfied during a stop state of the power supply, the stop state; and a second control unit that is driven with a supply of power independently from the first control unit, and controls charging of the capacitor.

An image forming apparatus according to still another aspect of the present invention, which forms an image on a medium using an electrophotographic method, includes a fixing unit including a fixing member that applies pressure and heat to a medium, on which a toner image is formed, to fix the toner image on the medium; a first heating member that produces heat with a supply of power from a commercial power supply, and heats the fixing member; a capacitor; a charger that charges the capacitor with a supply of power from the commercial power supply; a second heating member that produces heat with a supply of power from the capacitor, and heats the fixing member; a first control unit that stops, when a predetermined condition is satisfied, a power supply to other power loads except for a part of power loads of the heating unit, and releases, when the predetermined condition is satisfied during a stop state of the power supply, the stop state; and a second control unit that is driven with a supply of power independently from the first control unit, and controls charging of the capacitor.

An auxiliary power unit according to still another aspect of the present invention includes a first capacitor; a first charger that charges the first capacitor with a supply of power from the commercial power supply; a first terminal-voltage detection circuit that detects a terminal voltage of the first capacitor; a second capacitor serially connected to the first capacitor; a second charger that charges the second capacitor with a supply of power from the commercial power supply; a second terminal-voltage detection circuit that detects a terminal voltage of the second capacitor; and a control unit that switches a charging operation between the first charger and the second charger so that the terminal voltage reaches a final target voltage based on results of detection by the first terminal-voltage detection circuit and the second terminal-voltage detection circuit.

A fixing unit according to still another aspect of the present invention includes a fixing member that applies pressure and heat to a medium, on which a toner image is formed, to fix the toner image on the medium; first heating member that produces heat with a supply of power from a commercial power supply, and heats the fixing member; and a second heating member that produces heat with a supply of power from a first capacitor and a second capacitor in an auxiliary power unit. The auxiliary power unit includes the first capacitor; a first charger that charges the first capacitor with a supply of power from the commercial power supply; a first terminal-voltage detection circuit that detects a terminal voltage of the first capacitor; the second capacitor serially connected to the first capacitor; a second charger that charges the second capacitor with a supply of power from the commercial power supply; a second terminal-voltage detection circuit that detects a terminal voltage of the second capacitor; and a control unit that switches a charging operation between the first charger and the second charger so that the terminal voltage reaches a final target voltage based on results of detection by the first terminal-voltage detection circuit and the second terminal-voltage detection circuit.

An image forming apparatus according to still another aspect of the present invention, which forms an image on a medium using an electrophotographic method, includes a fixing unit including a fixing member that applies pressure and heat to a medium, on which a toner image is formed, to fix the toner image on the medium; first heating member that produces heat with a supply of power from a commercial power supply, and heats the fixing member; and a second heating member that produces heat with a supply of power from a first capacitor and a second capacitor in an auxiliary power unit. The auxiliary power unit includes the first capacitor; a first charger that charges the first capacitor with a supply of power from the commercial power supply; a first terminal-voltage detection circuit that detects a terminal voltage of the first capacitor; the second capacitor serially connected to the first capacitor; a second charger that charges the second capacitor with a supply of power from the commercial power supply; a second terminal-voltage detection circuit that detects a terminal voltage of the second capacitor; and a control unit that switches a charging operation between the first charger and the second charger so that the terminal voltage reaches a final target voltage based on results of detection by the first terminal-voltage detection circuit and the second terminal-voltage detection circuit.

The other objects, features, and advantages of the present invention are specifically set forth in or will become apparent from the following detailed description of the invention when read in conjunction with the accompanying drawings.

DETAILED DESCRIPTION

Exemplary embodiments of a heating unit, an auxiliary power unit, a fixing unit, and an image forming apparatus according to the present invention are explained in detail lower than with reference to the accompanying drawings.

Figure 1:
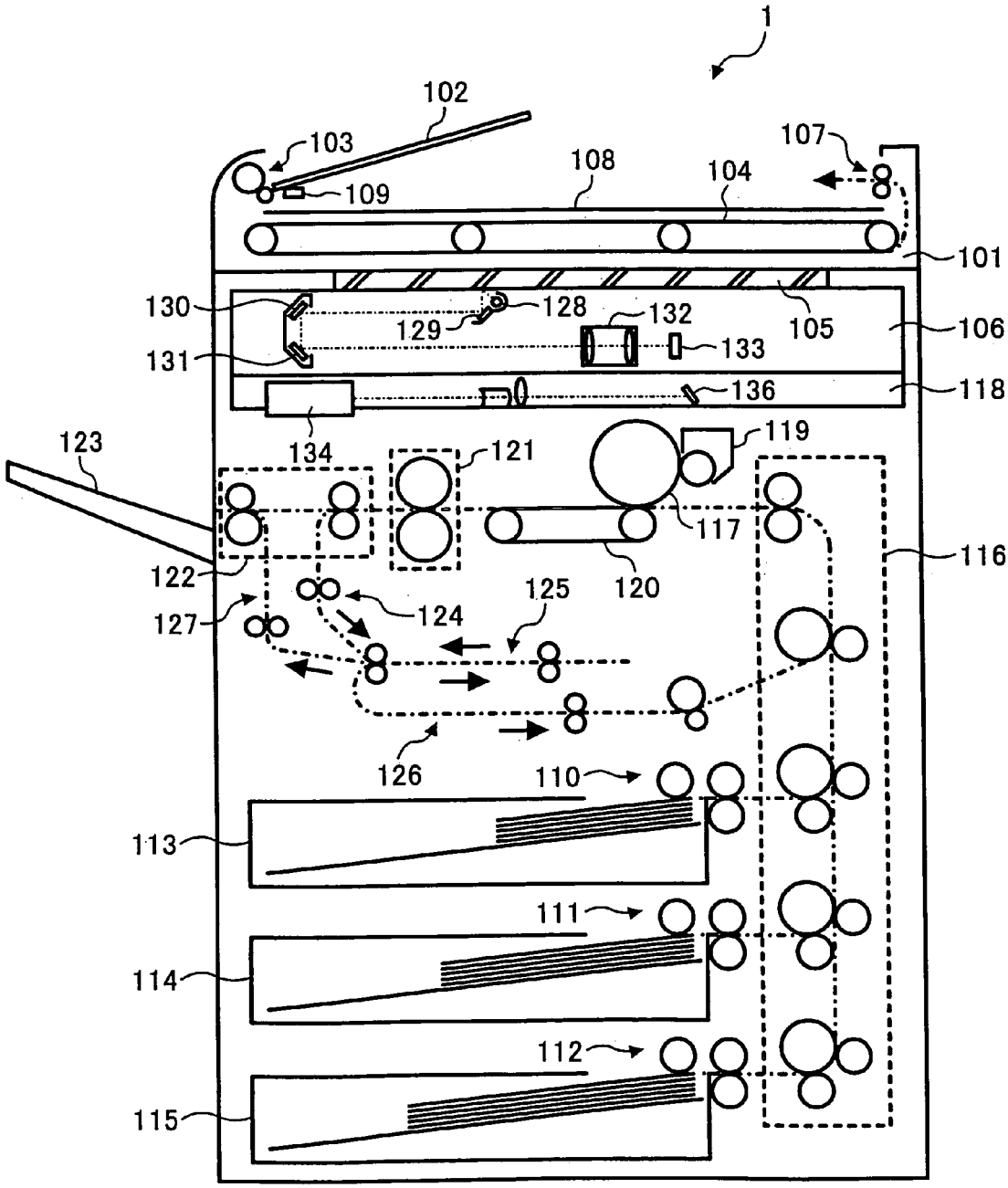
FIG. 1 is a vertical cross section of a digital copying machine according to a first embodiment of the present invention.

FIG. 1 is a vertical cross section of a digital copying machine 1 (hereinafter, "copying machine 1") according to a first embodiment of the present invention. The copying machine 1 realizes the image forming apparatus according to the present invention, which is a multifunction product. More specifically, the copying machine 1 includes a copying function and other functions such as a printer function and a facsimile function. The copying function, the print function, and the facsimile function can be sequentially switched and selected through an operation of an application switch key provided in an operation unit (not shown). Based on the configuration, a mode is switched to a copying mode when the copying function is selected, it is switched to a print mode when the printer function is selected, and it is switched to a facsimile mode when the facsimile function is selected.

A schematic configuration of the copying machine 1 and an operation in the copying mode are explained lower than. As shown in FIG. 1, a document with the image face up is set on a document table 102 of an automatic document feeder (ADF) 101. When a start key in the operation unit (not shown) is pressed, the document is fed by a paper feed roller 103 and a paper feed belt 104 to a fixed position on the document table 102 including a contact glass 105. The ADF 101 has a counting function of counting the number of documents each time feeding of a sheet of document is completed. The document on the contact glass 105 is read by an image reader 106 to obtain image information for the document, and the document is discharged onto a paper discharge base 108 by the paper feed belt 104 and a discharge roller 107.

If a document set detector 109 detects that the next document is present on the document table 102, the lowest document on the document table 102 is fed to the contact glass 105 by the paper feed roller 103 and the paper feed belt 104. The document on the contact glass 105 is read by the image reader 106 to obtain image formation for the document, and the document is discharged onto the sheet discharge base 108 by the paper feed belt 104 and the discharge roller 107. The paper feed roller 103, the paper feed belt 104, and the discharge roller 107 are driven by a conveying motor.

The image reader 106 includes a light source 128, mirrors 129 to 131, a lens 132, and a charge-coupled device (CCD) 133.

Any of a first paper feed device 110, a second paper feed device 111, and a third paper feed device 112 selected feeds a transfer paper loaded thereon, and the transfer paper is conveyed by a vertical conveying unit 116 up to a position where it is in contact with a photosensitive element 117. The photosensitive element 117 employs, for example, a photosensitive drum, and is made to rotate by a main motor (not shown).

The image data read from the document by the image reader 106 is subjected to predetermined image processing by an image processor (not shown), and is converted to optical information by a writing unit 118. The photosensitive drum 117 is uniformly charged by a charger (not shown), and the photosensitive drum 117 charged is exposed with the optical information from the writing unit 118 and an electrostatic latent image is formed thereon. The electrostatic latent image on the photosensitive drum 117 is developed by a developing device 119 to be a toner image. The writing unit 118, the photosensitive drum 117, the developing device 119, and other peripheral devices (not shown) around the photosensitive drum 117 constitute a printer engine that forms an image on a medium such as a sheet of paper using an electrophotographic method. It is noted that the writing unit 118 includes a laser writing device 134 and a reflecting mirror 136.

A conveying belt 120 serves as a unit for paper conveyance and also as a unit for image transfer, and is applied with transfer bias from a power supply. The conveying belt 120 transfers a toner image on the photosensitive drum 117 to a transfer paper while conveying the transfer paper from the vertical conveying unit 116 at a speed equal to that of the photosensitive drum 117. A fixing unit 121 fixes the toner image on the transfer paper, and a paper discharge unit 122 discharges the transfer paper onto a paper discharge tray 123. After the toner image is transferred, toner remaining on the photosensitive drum 117 is cleaned by a cleaning device (not shown).

The operation so far is performed when an image is copied on one side of the paper in an ordinary copying mode. If images are copied on both sides of the transfer paper in a double-sided copying mode, a transfer paper is fed from any one of paper feed trays 113 to 115, an image is formed on the surface of the transfer paper in the above manner. The path for the transfer paper with the image is switched so that it is conveyed not to the paper discharge tray 123 but to a paper feeding path 124 for double-sided copying. The transfer paper is switched back and turned upside down by a reversing unit 125, and is conveyed to a paper conveying unit 126 for double-sided copying.

The transfer paper conveyed to the paper conveying unit 126 is conveyed by this paper conveying unit 126 to the vertical conveying unit 116, and is conveyed by the vertical conveying unit 116 to a position where it is in contact with the photosensitive drum 117. The toner image formed on the photosensitive drum 117 in the above manner is transferred to the rear surface of the transfer paper, and the toner image is fixed on the transfer paper by the fixing unit 121 to obtain double-sided copied paper. The double-sided copied paper is discharged to the paper discharge tray 123 by the paper discharge unit 122.

If the transfer paper is to be reversely discharged, the reversing unit 125 switches back the transfer paper, and reverses it. The transfer paper reversed is conveyed not to the paper conveying unit 126 but is conveyed to a reversely-discharged-paper conveying path 127, and is discharged to the paper discharge tray 123 by the paper discharge unit 122.

In the print mode, instead of the image data from the image processor, image data from an external device is input to the writing unit 118, and an image is formed on the transfer paper in the above manner.

In the facsimile mode, a facsimile transmitter/receiver (not shown) transmits image data from the image reader 106 to the other party and receives image data from the other party. The facsimile transmitter/receiver inputs the image data received to the writing unit 118 instead of the image data from the image processor, and an image is formed on the transfer paper in the above manner.

The copying machine 1 includes a large capacity tray (LCT) and a finisher (both of which are not shown), and an operation unit. The finisher performs sorting, punching, and stapling on sheets of paper copied. Set on the operation unit are a mode to read a document, a magnification of copying, a paper feed stage, and any post-process by the finisher, and a display for an operator is displayed thereon.

Figure 2:
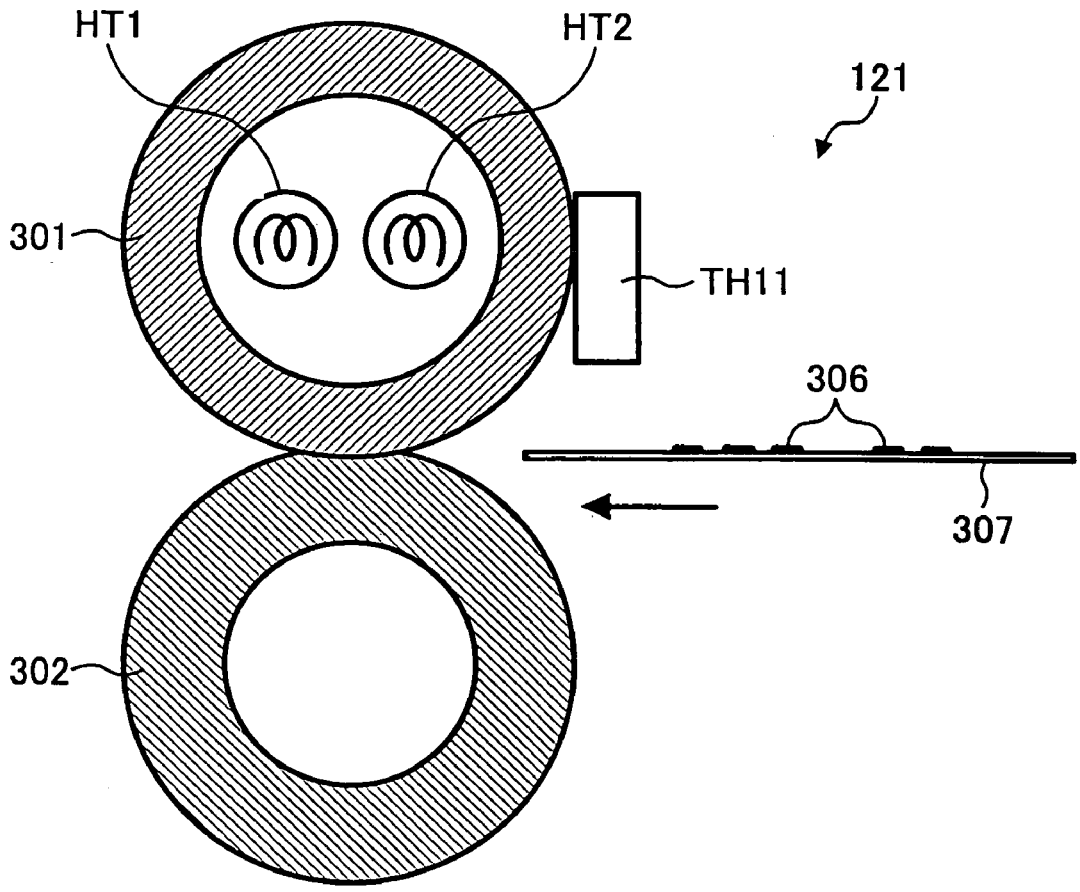
FIG. 2 is a diagram for explaining a fixing unit according to the first embodiment.

The configuration of the fixing unit 121 is explained lower than with reference to FIG. 2. The fixing unit 121 realizes the heating unit and the fixing unit according to the present invention. The fixing unit 121 includes a fixing roller 301 that is a target to be heated, and a pressing roller 302 that is formed of an elastic member such as silicone rubber and is pressed against the fixing roller 301 with a predetermined pressure force by a pressing unit (not shown). A fixing member and a pressing member are generally a roller, but either one or both of the members may be formed with an endless belt. A fixing heater HT1 and a fixing heater HT2 are provided in arbitrary locations of the fixing unit 121. For example, the fixing heaters HT1 and HT2 are arranged inside the fixing roller 301, and the fixing roller 301 is heated from the inside of the fixing roller 301.

A drive mechanism (not shown) rotates the fixing roller 301 and the pressing roller 302. A temperature sensor (e.g. thermistor) TH11 is made in contact with the surface of the fixing roller 301 to detect a temperature (fixing temperature) of the surface of the fixing roller 301. A sheet 307 is a medium such as a transfer paper that carries a toner image 306. When the sheet 307 passes through a nip part between the fixing roller 301 and the pressing roller 302, the toner image 306 is heated and pressed by the fixing roller 301 and the pressing roller 302 to be fixed on the sheet 307.

The fixing heater HT2 as a first heating member is a main heater that is turned on when the temperature of the fixing roller 301 does not reach a predetermined target temperature Tt as a reference and heats the fixing roller 301. The fixing heater HT1 as a second heating member is an auxiliary heater that is turned on when a main power to the copying machine 1 is turned on or during a rising period from returning from a power saving mode explained later to being ready for copying. In other words, the fixing heater HT1 is turned on when the fixing unit 121 is warmed up and heats the fixing roller 301.

Figure 3:
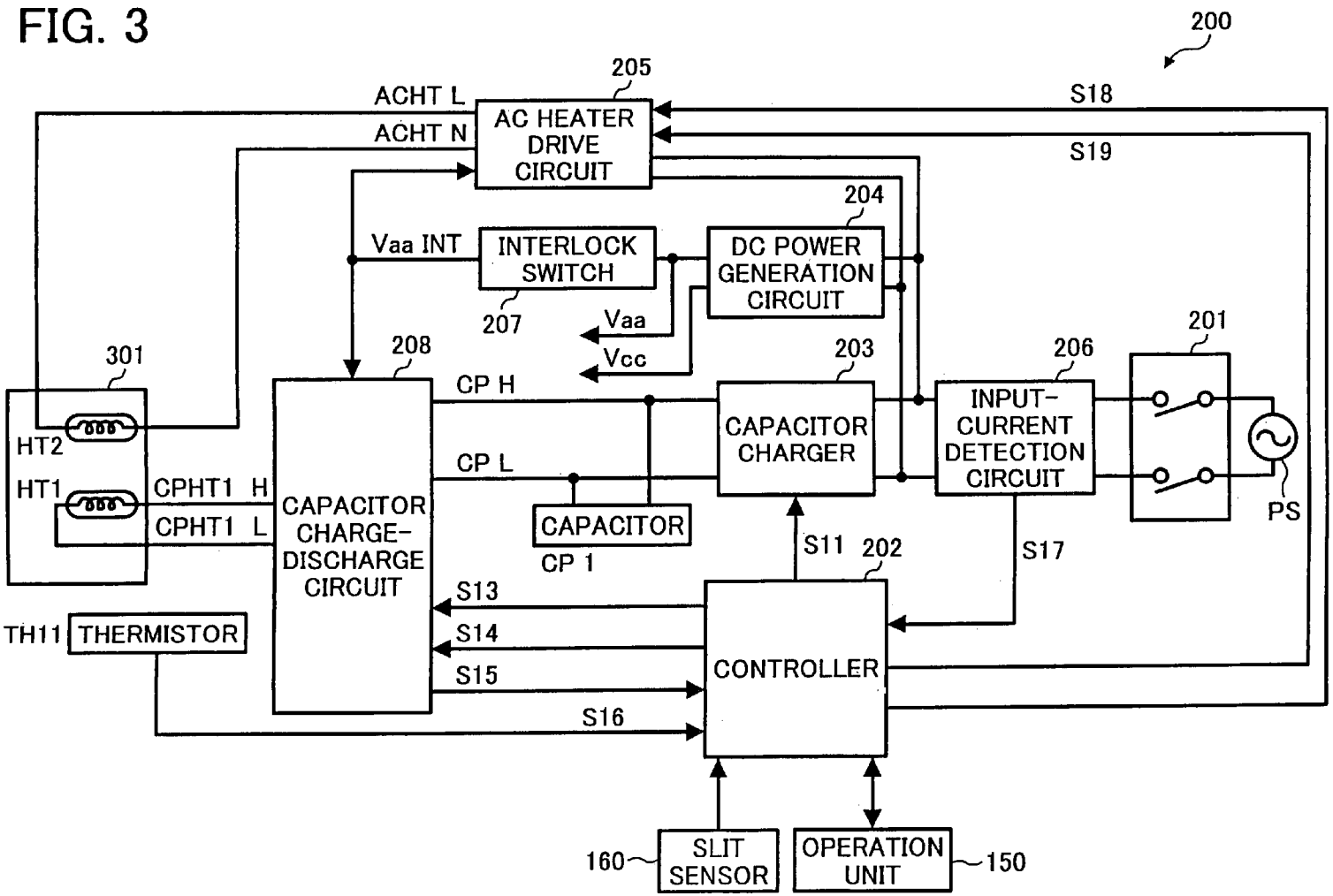
FIG. 3 is a circuit diagram of a power control system of the digital copying machine mainly including the fixing unit.

FIG. 3 is a diagram of a configuration of a power control system for the copying machine 1 mainly including the fixing unit 121. The power control system includes a main power supply SW 201 that turns on/off a power supply from an alternating-current (AC) power supply (commercial AC power supply) PS, and a microcomputer. The power control system also includes a controller 202 functioning as a control unit that controls components of a power supply circuit 200 and other parts, a capacitor CP1 that is an auxiliary power supply for the fixing heater HT1, and a capacitor charger 203 that serves as a charger for charging the capacitor CP1. The power control system further includes a direct-current (DC) power generation circuit 204 that generates DC power for the copying machine 1, an AC-heater drive circuit 205 that supplies AC power to the fixing heater HT2, an input-current detection circuit 206 that detects whether a current is input from the AC power supply PS, an interlock switch 207, and a capacitor charge-discharge circuit 208 that performs discharge of the capacitor CP1 and supplies DC power to the fixing heater HT1.

The AC power supply PS supplies AC power to the AC-heater drive circuit 205, the DC-power generation circuit 204, the capacitor charger 203 through the main power supply SW 201, and the input-current detection circuit 206.

The controller 202 controls mainly the components of the power supply circuit 200, and controls the operations of the capacitor charger 203, the AC-heater drive circuit 205, and the capacitor charge-discharge circuit 208. More specifically, the controller 202 outputs a control signal S11 to the capacitor charger 203 so as to control a charging operation to the capacitor CP1 by the capacitor charger 203. The controller 202 outputs a control signal S13 and a control signal S14 to the capacitor charge-discharge circuit 208 so as to control an on/off operation of the fixing heater HT1 by the capacitor charge-discharge circuit 208. The controller 202 outputs control signals S18 and S19 to the AC-heater drive circuit 205 to control an on/off operation of the fixing heater HT2 by the AC-heater drive circuit 205. Furthermore, the controller 202 estimates the number of sheets of documents set on the ADF 101 based on a detection signal input from a slit sensor 160, and predicts a time required for a copy job per operation mode based on the number of sheets estimated, the number of sheets to be copied set in an operation unit 150, and a time required for printing per sheet in each operation mode (fast mode, slow mode).

The input-current detection circuit 206 is provided between the main power supply SW 201, the AC-heater drive circuit 205, the DC-power generation circuit 204, and the capacitor charger 203. The input-current detection circuit 206 detects an input current of AC power input through the main power supply SW 201, and outputs a current detection signal S17 to the controller 202. The input current fluctuates according to each operating status of the AC-heater drive circuit 205, the DC-power generation circuit 204, the capacitor charger 203, and the image forming apparatus.

The DC-power generation circuit 204 generates power Vcc and power Vaa based on the AC power input through the main power supply SW 201, and outputs the power Vcc and the power Vaa to the components. The power Vcc is used mainly for the control system of the image forming apparatus, and the power Vaa is used mainly for the drive system and high- and medium-voltage power supply.

The interlock switch 207 is a switch that is interlocked with a cover (not shown) or the like of the copying machine 1 to turn the power on/off. If the copying machine 1 includes a drive member and an application member for the high- and medium-voltage power that are able to be touched when the cover is opened, the power is cut off when the cover is opened so as to stop the operation of the drive member or to stop applying a voltage to the application member. A part of the power Vaa generated in the DC-power generation circuit 204 is input to the interlock switch 207, and is input to the capacitor charge-discharge circuit 208 and the AC-heater drive circuit 205 through the interlock switch 207.

The AC-heater drive circuit 205 turns on/off the fixing heater HT2 according to the control signals S18 and S19 input from the controller 202.

The capacitor charger 203 is connected to the capacitor CP1, and charges the capacitor CP1 based on the control signal S11 input from the controller 202.

The capacitor CP1 is formed with a capacitor with large capacity such as the electric double layer capacitor. The capacitor CP1 is connected to the capacitor charger 203 and the capacitor charge-discharge circuit 208. The capacitor CP1 is charged by the capacitor charger 203 and the power charged is supplied to the fixing heater HT1 under the on/off control of the capacitor charge-discharge circuit 208.

The capacitor charge-discharge circuit 208 discharges the power accumulated in the capacitor CP1 according to the control signals S13 and S14 input from the controller 202, and turns on/off the fixing heater HT1.

The thermistor TH11 is provided near the fixing roller 301, and outputs a detection signal S16 according to the surface temperature of the fixing roller 301 to the controller 202. Since the resistance of the thermistor TH11 changes according to temperature, the controller 202 detects the surface temperature of the fixing roller 301 from the detection signal S16 obtained based on the change in the resistance due to temperature.

Figure 4:
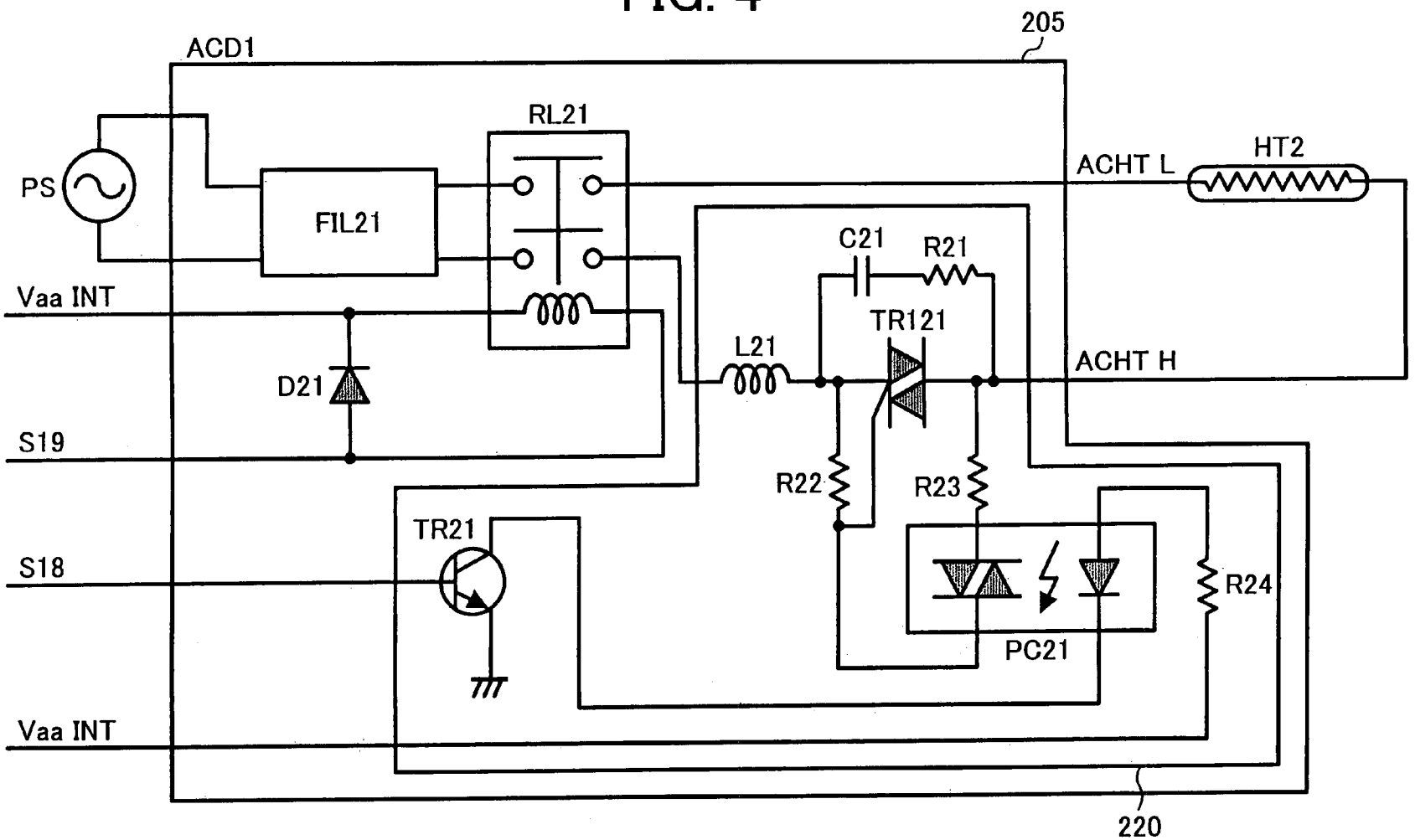
FIG. 4 is a circuit diagram of an AC heater drive circuit according to the first embodiment.

FIG. 4 is a diagram of a configuration of the AC-heater drive circuit 205 of FIG. 3. The AC-heater drive circuit 205 includes a filter FIL21 that removes noise of the AC power input, a fixing relay RL21 for safety to be turned on/off according to the control signal S19 input from the controller 202, a diode D21 for preventing counter electromotive force of the fixing relay RL21, and a heater on/off circuit 220 that turns on/off the fixing heater HT2 based on the control signal S18 input from the controller 202.

The AC power supply PS is connected to one end of the fixing heater HT2 through the filter FIL21 and the fixing relay RL21. The other end of the fixing heater HT2 is connected to the heater on/off circuit 220.

The heater on/off circuit 220 includes a triac TRI21 for turning on/off the AC power, a photocoupler PC21 for insulating a signal from the controller 202 that is a secondary side, and a transistor TR21 for driving a light emitting diode (LED) on a light emission side of the photocoupler PC21. The heater on/off circuit 220 also includes a noise-absorption snubber circuit including a capacitor C21 and a resistor R21, an inductance L21 for noise absorption, a resistor R22 that is a resistor for preventing a dynamic current, and resistors R23 and R24 that are resistors for restricting a current from the photocoupler PC21.

In the AC-heater drive circuit 205 configured as explained above, the fixing heater HT2 is supplied with power and is lit when both the fixing relay RL21 and the gates of the transistor TR21 are on.

The controller 202 turns on/off the control signal S18 to be supplied to the gate of the transistor TR21 for the heater on/off circuit 220 in an on state of the control signal S19 that is supplied to the fixing relay RL21, and controls switching on/off of the fixing heater HT2.

Figure 5:
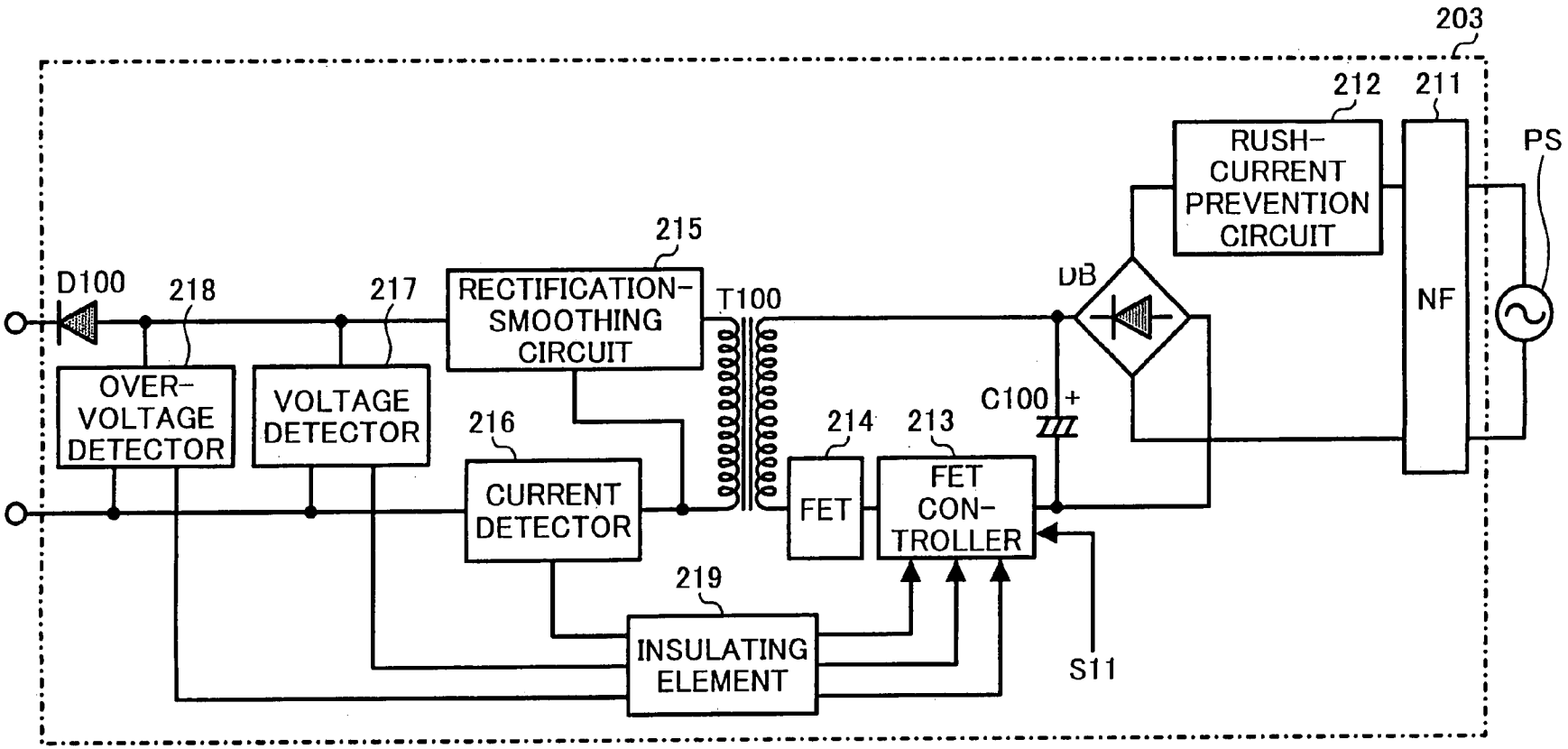
FIG. 5 is a circuit diagram of a capacitor charger according to the first embodiment.

FIG. 5 is a diagram of a configuration of the capacitor charger 203 of FIG. 3. The capacitor charger 203 includes a noise filter (NF) 211 that removes noise of an AC voltage input, a rush-current prevention circuit 212 that prevents a rush current, a diode bridge DB that rectifies AC power from the AC power supply PS input through the rush-current prevention circuit 212, and a capacitor C100 that performs smoothing on the AC voltage rectified. The capacitor charger 203 also includes a field-effect transistor (FET) controller 213 that controls switching of a FET 214 and controls the charging operation of the capacitor CP1 (see FIG. 3), the FET 214 that turns on/off a trance T100, and the trance T100 that boosts an input voltage. The capacitor charger 203 further includes a rectification-smoothing circuit 215 that performs rectification and smoothing on an output on the secondary side of the trance T100 to be converted to a DC output, a current detector 216 that detects a current, a voltage detector 217 that detects a voltage, an overvoltage detector 218 that detects overvoltage so as not to apply overvoltage to the capacitor CP1, a diode D100 for preventing a back flow from the capacitor CP1, and an insulating element 219.

The AC voltage input from the AC power supply PS is noise-removed by the noise filter 211, is rectified by the diode bridge DB through the rush-current prevention circuit 212, and is subjected to smoothing by the capacitor C100 to obtain a DC voltage to be input to a primary side of the trance T100. If the control signal S11 input from the controller 202 (see FIG. 3) is "on", the FET controller 213 starts switching control of the FET 214 to charge the capacitor CP1. The FET controller 213 controls switching of the FET 214 based on the respective detection signals input from the current detector 216, the voltage detector 217, and the overvoltage detector 218. The FET controller 213 performs constant current control, constant voltage control, or constant power control for charging the capacitor CP1. Generally, the capacitor CP1 is desired to be charged with the constant current. However, the capacitor CP1 is charged with the constant power controlled to allow reduction in the charging time.

The trance T100 is turned on/off by the FET 214, a primary-side input is boosted and is output from the secondary side. The secondary-side output of the trance T100 is subjected to rectification and smoothing by the rectification-smoothing circuit 215, and is output to the capacitor CP1 through the diode D100. The current, the voltage, and the overvoltage of the secondary-side output of the trance T100 after rectification and smoothing are detected by the current detector 216, the voltage detector 217, and the overvoltage detector 218, respectively, and each detection signal is input to the FET controller 213.

Figure 6:
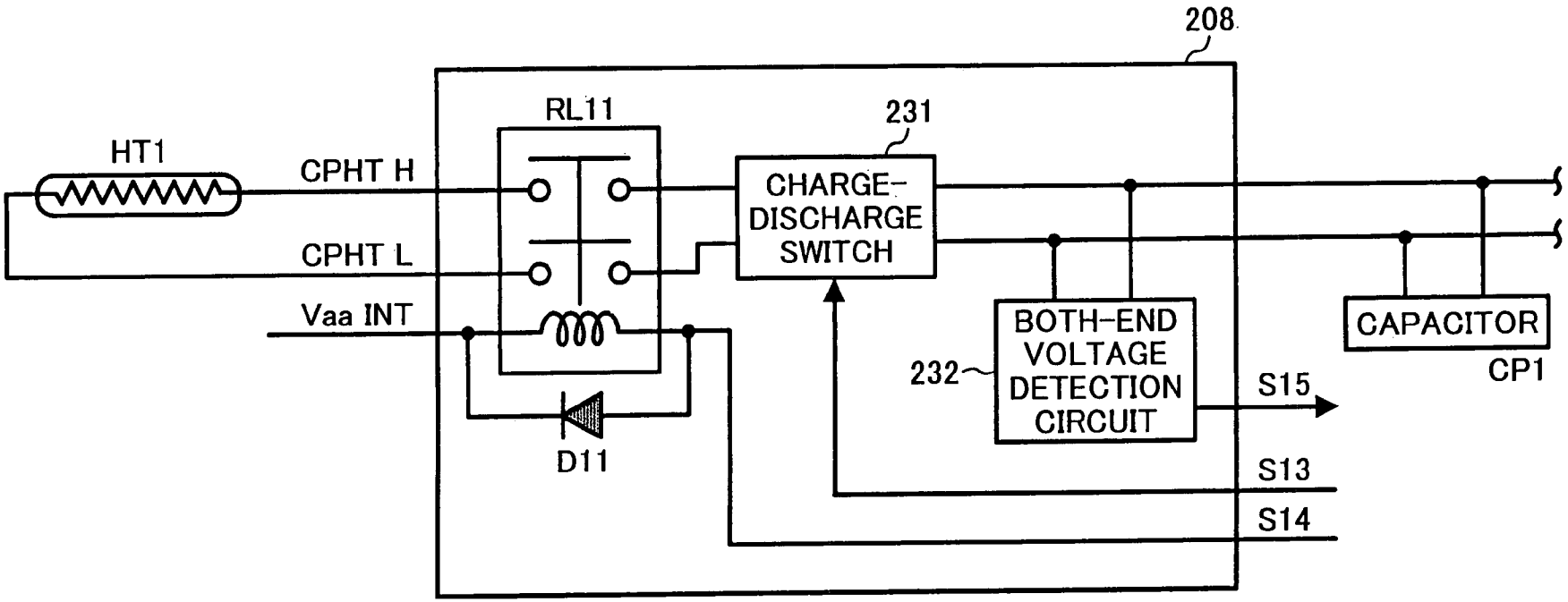
FIG. 6 is a circuit diagram of a capacitor charge-discharge circuit according to the first embodiment.

FIG. 6 is a diagram of a configuration of the capacitor charge-discharge circuit 208 of FIG. 3. The capacitor charge-discharge circuit 208 includes a charge-discharge switch 231, a fixing relay RL11 for safety, a diode D11 for preventing counter electro-motive force of the fixing relay RL11, and a terminal voltage detection circuit 232 that detects a terminal voltage of the capacitor CP1.

Both ends of the capacitor CP1 are connected with the charge-discharge switch 231 and the fixing relay RL11. The charge-discharge switch 231 is turned on/off by the control signal S13 input from the controller 202. Likewise, the fixing relay RL11 is turned on/off by the control signal S14 input from the controller 202.

When both of the charge-discharge switch 231 and the fixing relay RL11 are turned on, charges accumulated in the capacitor CP1 are discharged to supply power to the fixing heater HT1.

The terminal voltage detection circuit 232 detects a terminal voltage of the capacitor CP1 and outputs a voltage detection signal S15 indicating the terminal voltage detected, to the controller 202. The controller 202 always monitors the voltage detection signal S15, and monitors the charged state of the capacitor CP1.

Figure 7:
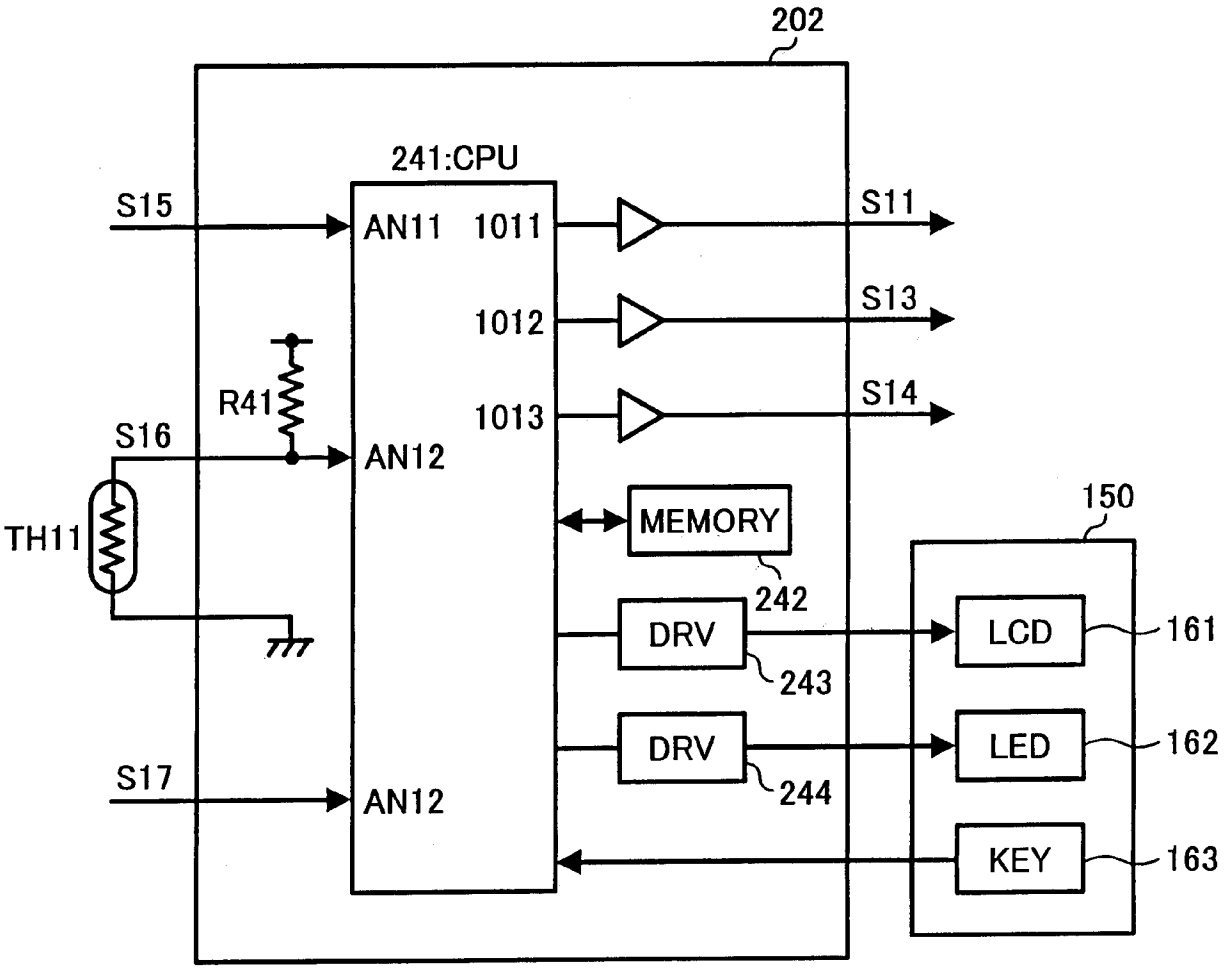
FIG. 7 is a circuit diagram of a main controller according to the first embodiment.

FIG. 7 is a diagram of a schematic configuration of the controller 202 of FIG. 3. The controller 202 includes a central processing unit (CPU) 241 and a memory 242.

The CPU 241 communicates with the memory 242 that stores a program to control the copying machine 1 and stores data, and controls the printer engine and the power supply circuit 200 based on the program stored in the memory 242.

Input to the CPU 241 are the voltage detection signal (analog signal) S15, the detection signal (analog signal) S16, and the current detection signal (analog signal) S17 through analog (AN) ports AN11 and AN12. The voltage detection signal S15 indicates the terminal voltage of the capacitor CP1 detected by the terminal voltage detection circuit 232 of the capacitor charge-discharge circuit 208. The detection signal S16 indicates the voltage being divided by the resistance of the thermistor TH11 for detecting the surface temperature of the fixing roller 301 and the resistance of a resistor R41. The current detection signal S17 indicates an input current to the system detected by the input-current detecting circuit 206. These signals are input to the CPU 241.

The CPU 241 outputs the control signal S11, the control signal S13, the control signal S14, the control signal S18, and the control signal S19 through input-output (IO) ports IO11 to IO13. The control signal S11 causes charging to the capacitor CP1 to be turned on/off. The control signal S13 causes the charge-discharge switch 231 to be turned on/off. The control signal S14 causes the fixing relay RL11 to be turned on/off. The control signal S18 causes the heater on/off circuit 220 to be turned on/off, and the control signal S19 causes the fixing relay RL21 to be turned on/off (see also FIG. 3).

Furthermore, the CPU 241 controls the operation unit 150, and monitors entry of data through KEY 163 provided on the operation unit 150. DRV 243 is a driver that drives a liquid crystal display (LCD) 161, and DRV 244 is a driver that drives LED 162, both being controlled by the CPU 241.

Figure 8:
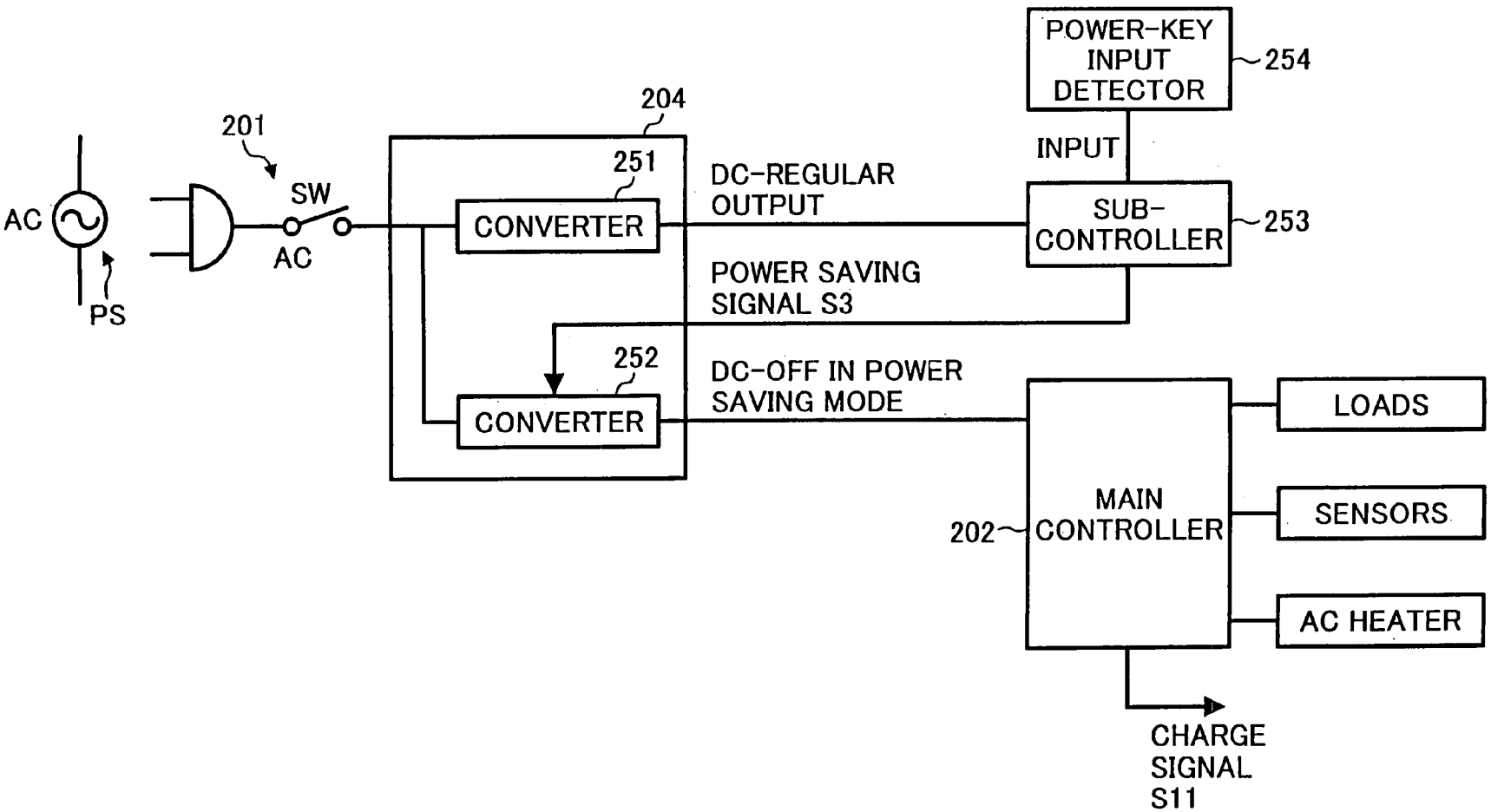
FIG. 8 is a circuit diagram for explaining functions of a sub-controller and other components according to the first embodiment.

FIG. 8 is a block diagram for explaining operations of the DC-power generation circuit 204. When the main power supply SW 201 is turned on, the AC power is supplied to the DC-power generation circuit 204, and DC power is generated by DC controllers (formed with a converter, etc.) 251 and 252 of the DC-power generation circuit 204. The DC power output of the DC controller 252 is supplied to the controller (main controller) 202, and the DC power output of the DC controller 251 is supplied to a sub-controller 253 (in addition, to the operation unit 150 and a charge control circuit 10 as explained later).

The sub-controller 253 is a control unit that includes a microcomputer and controls the power saving mode. In other words, the copying machine 1 includes a function of a so-called power saving mode. The copying machine 1 includes a function of achieving power saving and energy saving if a predetermined condition is satisfied, i.e., if a fixed time passes while the copying machine 1 is in a standby state in which it is not used. The function is realized by maintaining a power supply only to a part of power loads and stopping the power supply to almost all parts of the power loads including the main controller 202. In this case, when the predetermined condition is satisfied after the power supply to the large parts of the power loads is stopped, or when the predetermined condition is satisfied in a case where the user touches an operation key of the operation unit 150, the power supply to the power loads to which the power supply has been stopped is re-started.

In this example, if a fixed time passes in a standby state where the copying machine 1 is not used, that is, if certain conditions are ready for shifting the mode to the power saving mode, the sub-controller 253 outputs a power saving signal S3 to stop a DC output of the DC controller 252 (power controller). The DC controller 251 that supplies DC power to the sub-controller 253 regularly outputs DC power thereto. With this output, the main controller 202 stops its operation, and the control signals S11, S13, S14, S18, and S19 are not output. Accordingly, the loads such as various types of sensors, the capacitor charger 203, and the AC-heater drive circuit 205 stop their operations. Thus, power saving and energy saving can be achieved. When the sub-controller 253 detects that a predetermined key switch of the operation unit 150 is operated by a power-key input detector 254, the sub-controller 253 relieves the power saving signal S3 and restarts the power supply to the main controller 202 (power controller). Therefore, it is possible to supply power to the loads required for performing original functions of the copying machine 1. In addition, a return condition from the power saving mode may include detection of a document that is set on the document table 102, detection of facsimile (FAX) reception when the copying machine 1 includes a FAX transmitting/receiving function, and detection of reception of a printer job.

As explained above, in the power saving mode of the copying machine 1, after the shift to the power saving mode, the main controller 202 in particular with a large power consumption also stops, while only the sub-controller 253 that controls the power saving mode operates. Thus, the power-saving effect is significant.

However, if the power saving mode is not active, the main controller 202 controls the capacitor charger 203 so as to charge the capacitor CP1 according to the control signal S11 as necessary based on the voltage detection signal S15 indicating the voltage detected by the terminal voltage detection circuit 232. More specifically, if the voltage detection signal S15 is lower than the predetermined value, the main controller 202 determines that the charge amount of the capacitor CP1 is not enough, and causes the capacitor CP1 to be charged.

However, when the main controller 202 is at rest, the control signal (charge signal) S11 is not output. As a result, charging to the capacitor CP1 after the shift to the power saving mode is not performed. If so, there occur some inconveniences. That is, if the charge amount of the capacitor CP1 is insufficient upon shifting to the power saving mode, or if the power saving mode is continuous over a long time and natural discharge of the capacitor CP1 occurs, even if the mode is returned from the power saving mode and an image is to be formed in the copying machine 1, it is difficult to immediately heat the fixing roller 301, and the start of the image formation is delayed. As a result, the user has to wait for starting of the image formation for a long time.

Therefore, it is necessary to continue charging the capacitor CP1 by a required amount even if the power supply to the main controller 202 having a large power consumption is stopped after the shift to the power saving mode. Means for solving this problem are explained lower than.

Figure 9:
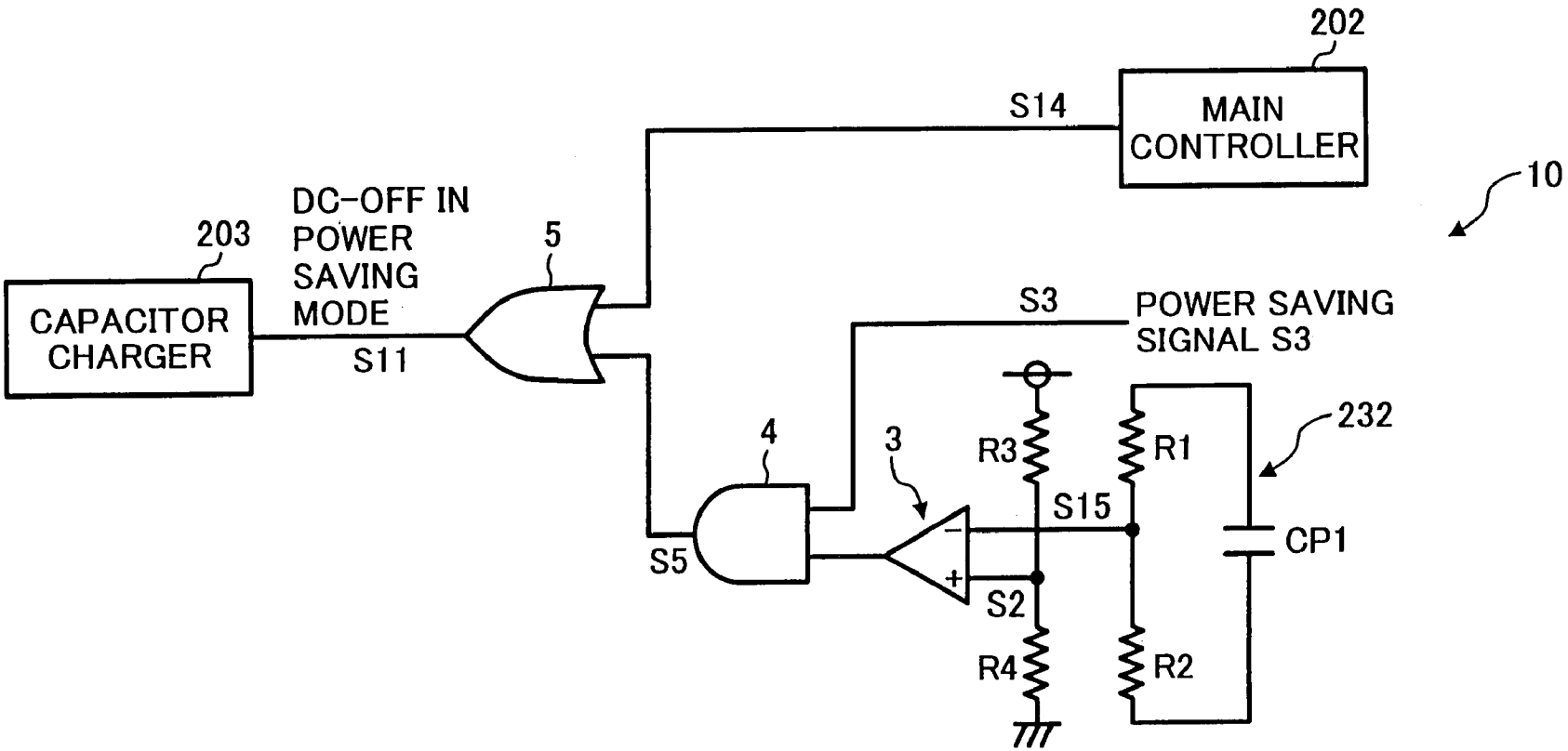
FIG. 9 is a circuit diagram of a charge control circuit according to the first embodiment.

FIG. 9 is a circuit diagram of the charge control circuit 10 capable of charging the capacitor CP1 by a necessary amount even if the power supply to the main controller 202 is stopped after the shift to the power saving mode.

The charge control circuit 10 is a circuit that realizes a charge controller and operates together with the sub-controller 253 by the DC power output from the DC controller 251 after the shift to the power saving mode. The charge control circuit 10 includes the terminal voltage detection circuit 232 that divides a terminal voltage (charging voltage) of the capacitor CP1 by resistors R1 and R2 serially connected to each other and detects the voltage, and a comparator circuit 3 that compares the voltage detection signal S15 from the terminal voltage detection circuit 232, with a predetermined reference voltage S2 obtained by dividing a predetermined supply voltage by resistors R3 and R4. Based on the comparison, it is possible to determine whether the charging voltage of the capacitor CP1 is so low that charging is needed.

If the charging voltage of the capacitor CP1 is in such a low level that charging is needed, the comparator circuit 3 outputs a high ("H") level signal (signal indicating that the level of the voltage detection signal S15 is lower than the reference voltage S2) to an AND circuit 4 (first signal). The power saving signal S3 ("H" level signal), that is, a signal (second signal) indicating the shift to the power saving mode is also input to the AND circuit 4. If the power saving signal S3 is in "H" level and the power saving mode is active, and if the output signal of the comparator circuit 3 is in "H" level and the charging voltage of the capacitor CP1 is in such a low level that charging is needed, the AND circuit 4 takes the logical product of these two and outputs a control signal S5 ("H" level signal) to an OR circuit 5.

The OR circuit 5 takes the logical sum of the control signal S14 and the control signal S5 and outputs the control signal S11 indicating an instruction to charge the capacitor CP1, to the capacitor charger 203 (In FIG. 3, the control signal S11 is directly output from the main controller 202 to the capacitor charger 203, but actually, the control signal S11 is output through the OR circuit 5.).

As explained above, even in the power saving mode in which the main controller 202 does not cause the capacitor CP1 to be charged, the charge control circuit 10 performs charging to the capacitor CP1 when the charging voltage of the capacitor CP1 is too low. Therefore, after the return from the power saving mode, the fixing roller 301 can be heated so quickly at any time, which allows image formation to be started immediately. Therefore, the user can be free from waiting for the starting of image formation for a long time, and usability is improved. It is noted that a circuit (not shown) is provided in the capacitor charger 203 to be used when the charging is performed by the control signal S11. The circuit determines that the capacitor CP1 reaches full charge when the voltage detection signal S15 reaches a predetermined value, and stops charging the capacitor CP1.

Figure 10:
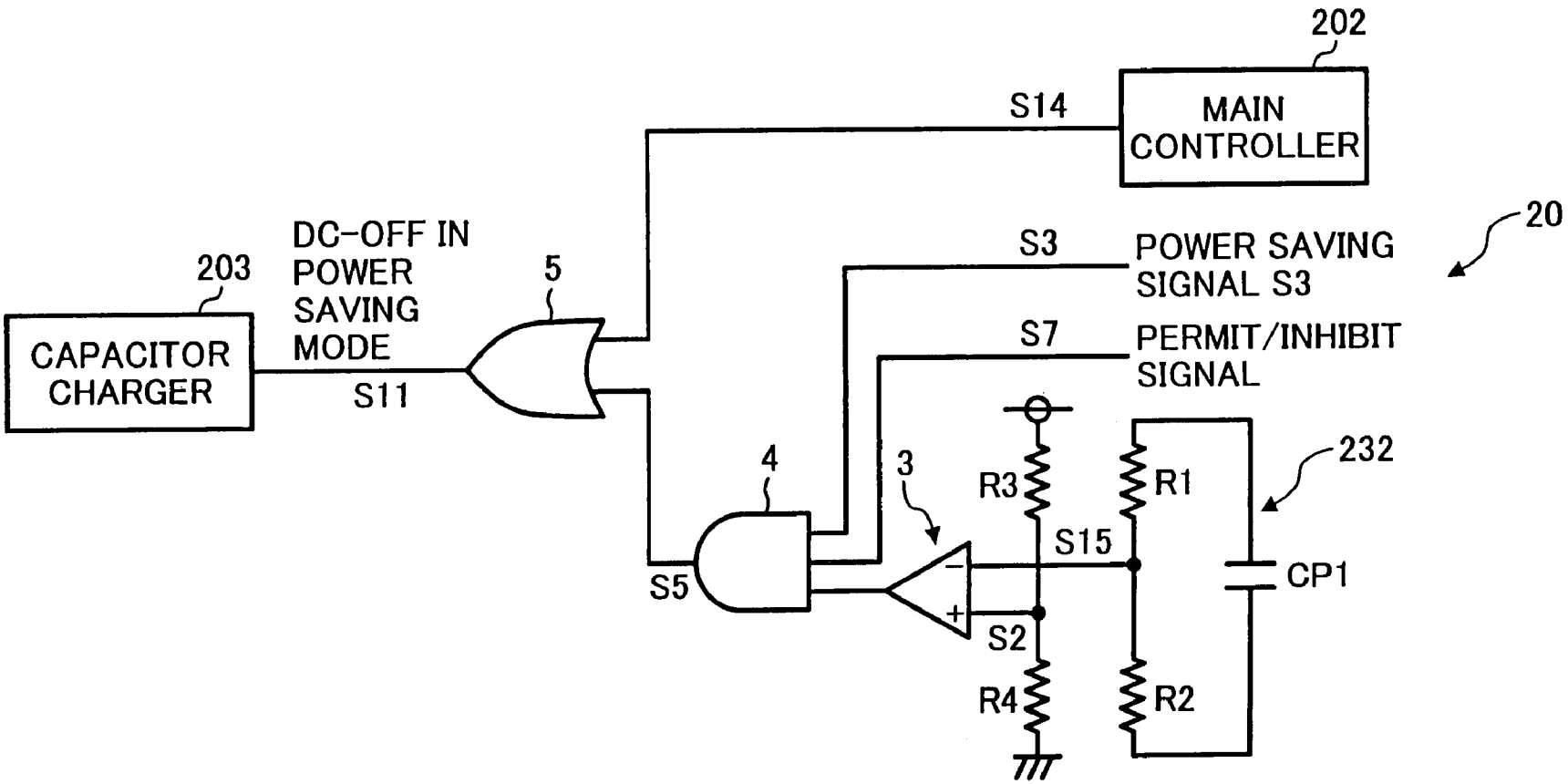
FIG. 10 is a circuit diagram of another configuration of the charge control circuit.

FIG. 10 is a circuit diagram of another configuration of the charge control circuit 10. The circuit elements of FIG. 10 having the same reference signs as these of FIG. 9 have the same functions as these of the charge control circuit 10 of FIG. 9, and detailed explanation thereof is omitted. A charge control circuit 20 of FIG. 10 is different from the charge control circuit 10 of FIG. 9 in that a permit/inhibit signal S7 (third signal) is input to the AND circuit 4. The permit/inhibit signal S7 is output from the operation unit 150 generally as an "H" level signal, but the permit/inhibit signal S7 is changed to a low ("L") level signal when the user operates a predetermined key through the operation unit 150. At this time, since the AND circuit 4 outputs the L-level signal, even if the charging voltage of the capacitor CP1 decreases after the shift to the power saving mode, the capacitor charger 203 does not charge the capacitor CP1.

More specifically, when the copying machine 1 is not used for a long time in such cases as an weekend and a long vacation, charging the capacitor CP1 is unnecessary even if the charging voltage of the capacitor CP1 decreases in the power saving mode, and if the charging is performed in these cases, such charging leads to a waste of power. In this case, if the user performs a predetermined key operation on the operation unit 150, then the charge control circuit 20 accepts an instruction as this key operation from the user to inhibit charging to the capacitor CP1 (acceptance unit). The permit/inhibit signal S7 is maintained in "L" level, and this signal becomes a signal indicating an instruction to inhibit charging to the capacitor CP1 from the user. Therefore, charging to the capacitor CP1 by the charge control circuit 20 is inhibited, and power saving is achieved. When the weekend or the long vacation is over, the user again performs a predetermined key operation on the operation unit 150, the permit/inhibit signal S7 returns to "H" level, and the capacitor CP1 in the power saving mode can be charged.

Figure 11:
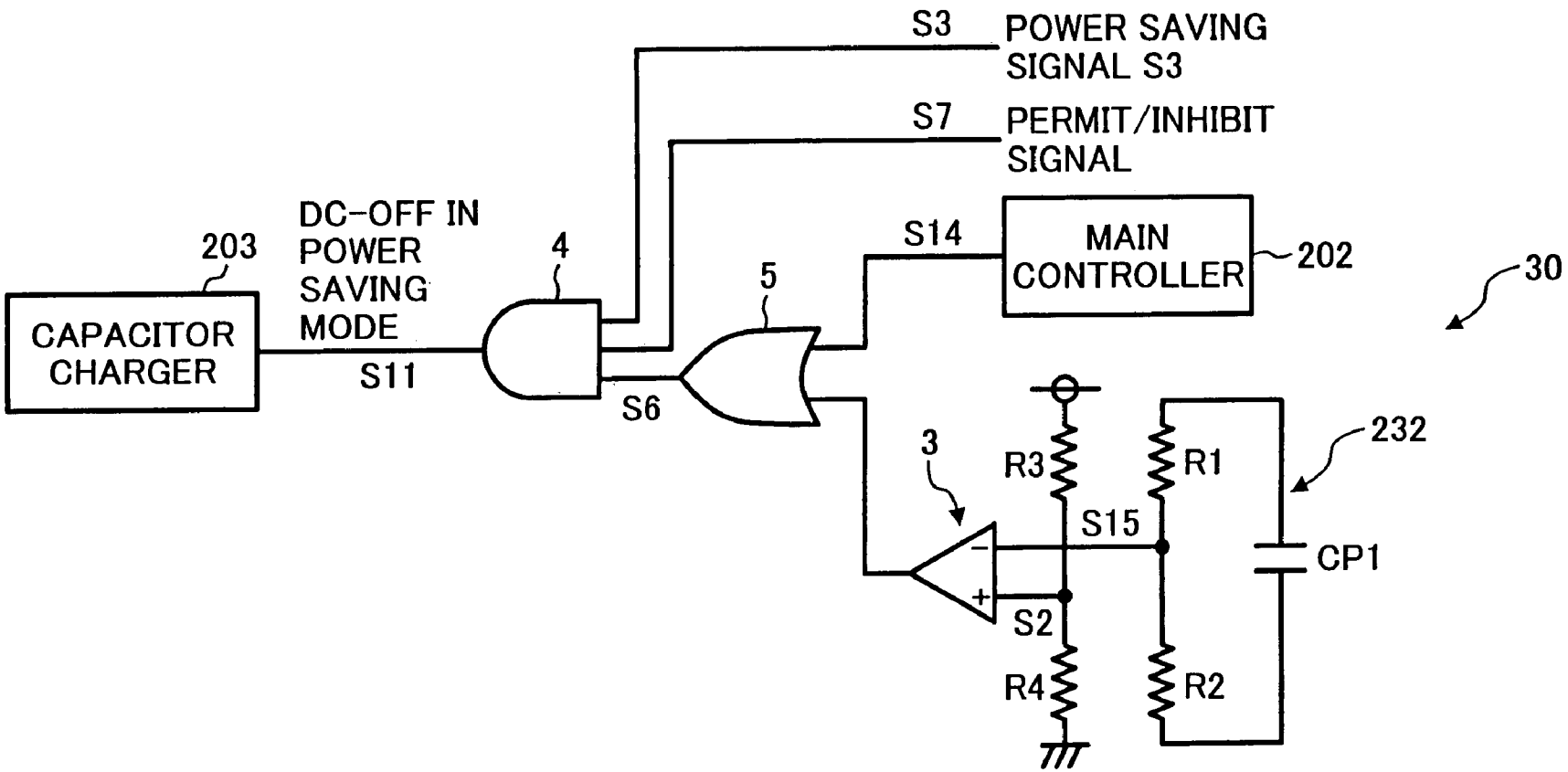
FIG. 11 is a circuit diagram of still another configuration of the charge control circuit.

FIG. 11 is a circuit diagram of still another configuration of the charge control circuit 10. The circuit elements of FIG. 11 having the same reference signs as these of FIG. 10 have the same functions as these of the charge control circuit 20 of FIG. 10, and detailed explanation thereof is omitted. A charge control circuit 30 of FIG. 11 is different from the charge control circuit 20 of FIG. 10 in that the AND circuit 4 is provided in the downstream side of the OR circuit 5. With this arrangement, if the permit/inhibit signal S7 is in "L" level by the predetermined key operation by the user, charging to the capacitor CP1 is inhibited also by the control signal S14 output from the main controller 202 even not in the power saving mode. Therefore, the charging to the capacitor CP1 is absolutely inhibited if necessary through the operation of the operation unit 150 by the user, and power saving becomes possible.

Figure 12:
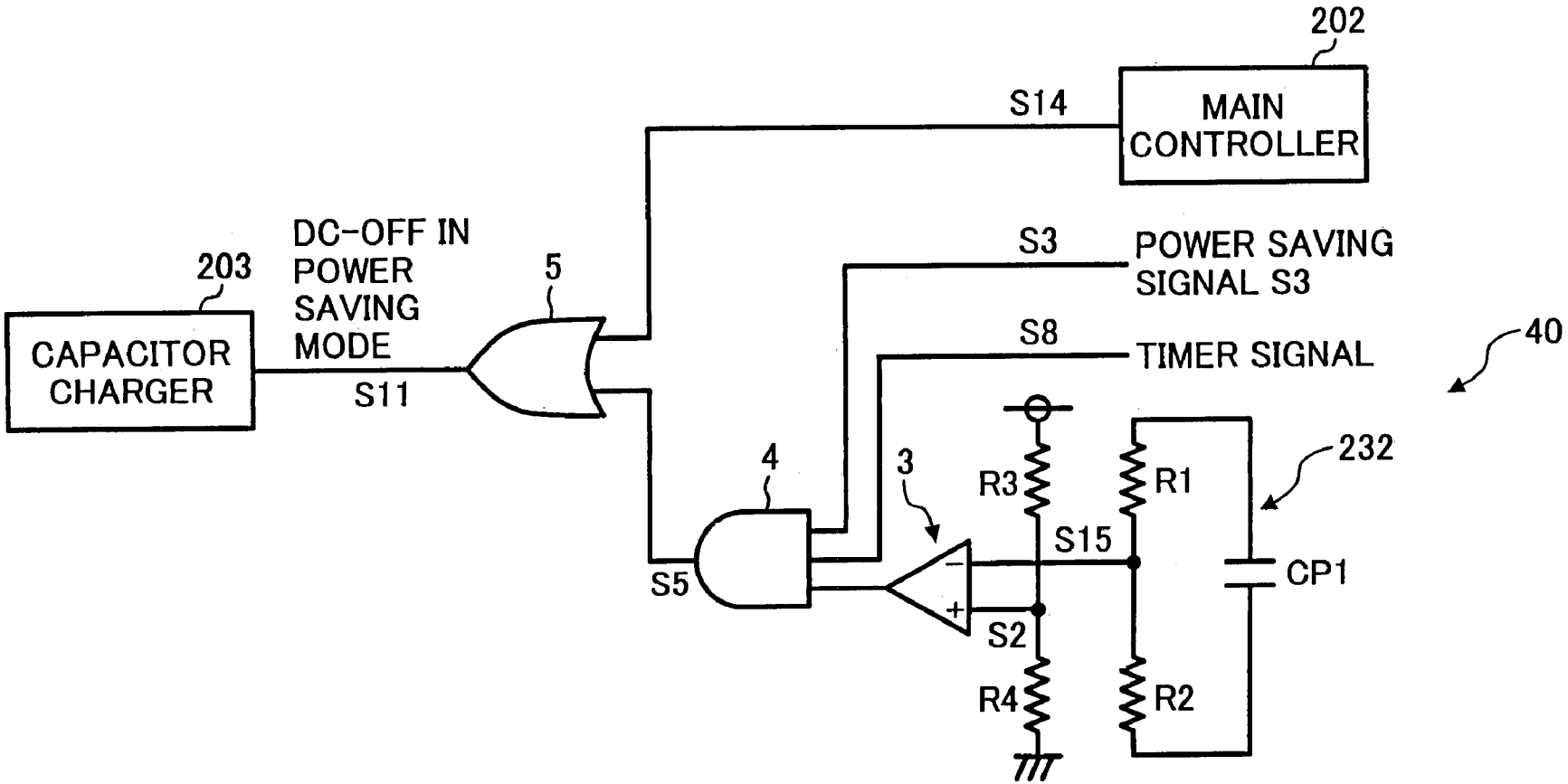
FIG. 12 is a circuit diagram of still another configuration of the charge control circuit.

FIG. 12 is a circuit diagram of still another configuration of the charge control circuit 10. The circuit elements of FIG. 12 having the same reference signs as these of FIG. 9 have the same functions as these of the charge control circuit 10 of FIG. 9, and detailed explanation thereof is omitted. A charge control circuit 40 of FIG. 12 is different from the charge control circuit 10 of FIG. 9 in that a timer signal S8 instead of the permit/inhibit signal S7 is input to the AND circuit 4. The sub-controller 253 includes a clock function and a timer function, and generally outputs the timer signal S8 as an "H" level signal, but changes the level of the timer signal S8 to "L" level in a predetermined time window (time determining unit). In other words, the timer signal S8 is changed to a signal indicating that the current time is in the predetermined time window. With this signal, during the predetermined time window (during night time), even if the charge of the capacitor CP1 is insufficient after the shift to the power saving mode, charging to the capacitor CP1 is inhibited. Wasteful charging is thereby prevented to allow power saving.

Figure 13:
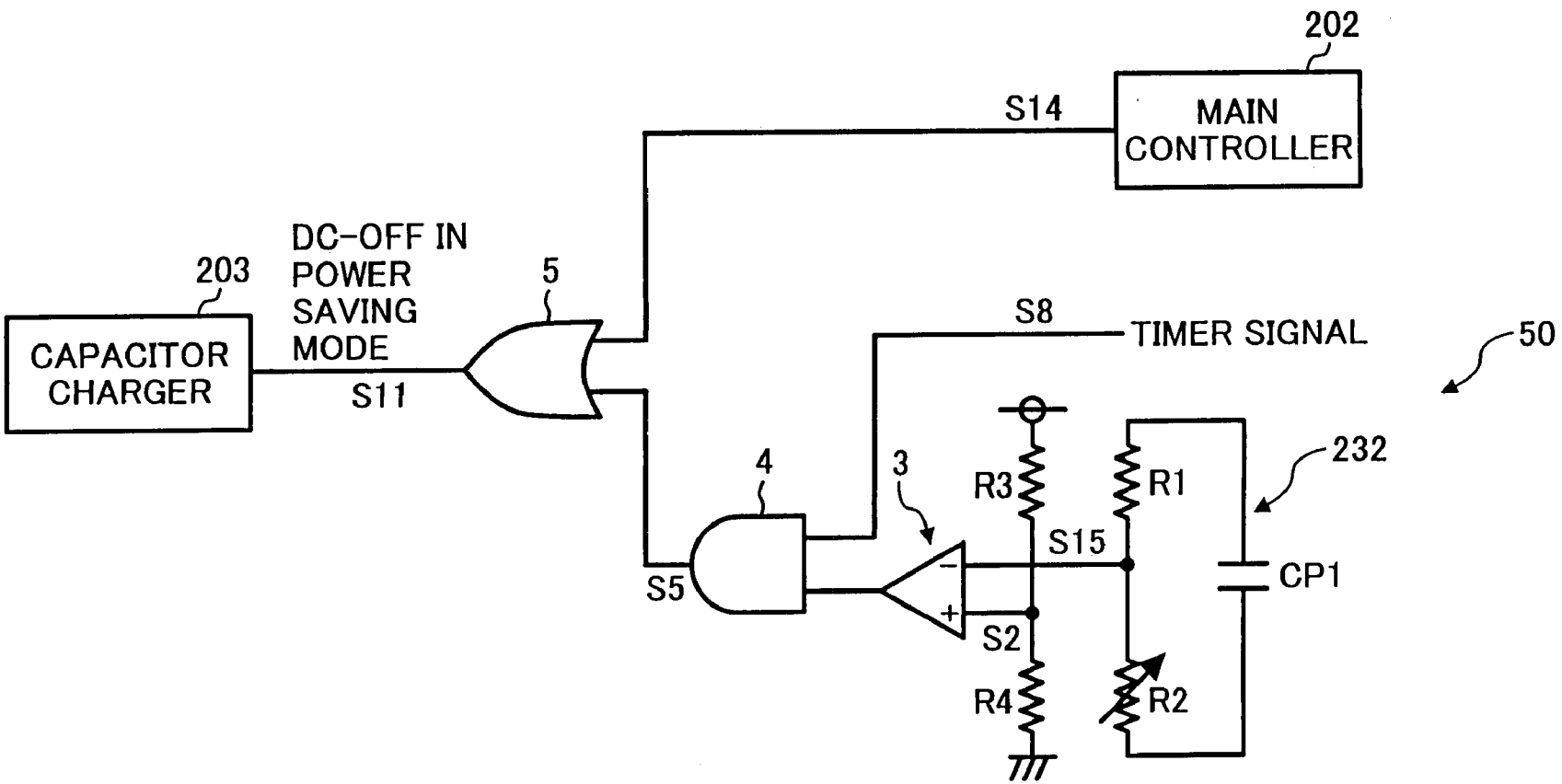
FIG. 13 is a circuit diagram of still another configuration of the charge control circuit.

FIG. 13 is a circuit diagram of still another configuration of the charge control circuit 10. The circuit elements of FIG. 13 having the same reference signs as these of FIG. 9 have the same functions as these of the charge control circuit 10 of FIG. 9, and detailed explanation thereof is omitted. A charge control circuit 50 of FIG. 13 is different from the charge control circuit 10 of FIG. 9 in that the resistor R2 (or the resistor R1, or both the resistors R1 and R2) forming the terminal voltage detection circuit 232 is formed with a variable resistor. With this arrangement, even under situations as follows, a service person can adjust a resistance of the variable resistor to adjust a value of the reference voltage S2 (variable unit). The situations are such that the performance of the capacitor CP1 changes according to changes with the passage of time, the time required for charging the capacitor CP1 up to the same voltage level is prolonged, and thereby charging to the capacitor CP1 has to be started earlier. Thus, it is possible to start charging the capacitor CP1 at earlier time after the shift to the power saving mode. In addition, by providing a variable resistor for at least one of the resistors R3 and R4, the magnitude of the reference voltage input to the comparator circuit 3 may be variable.

Figure 14:
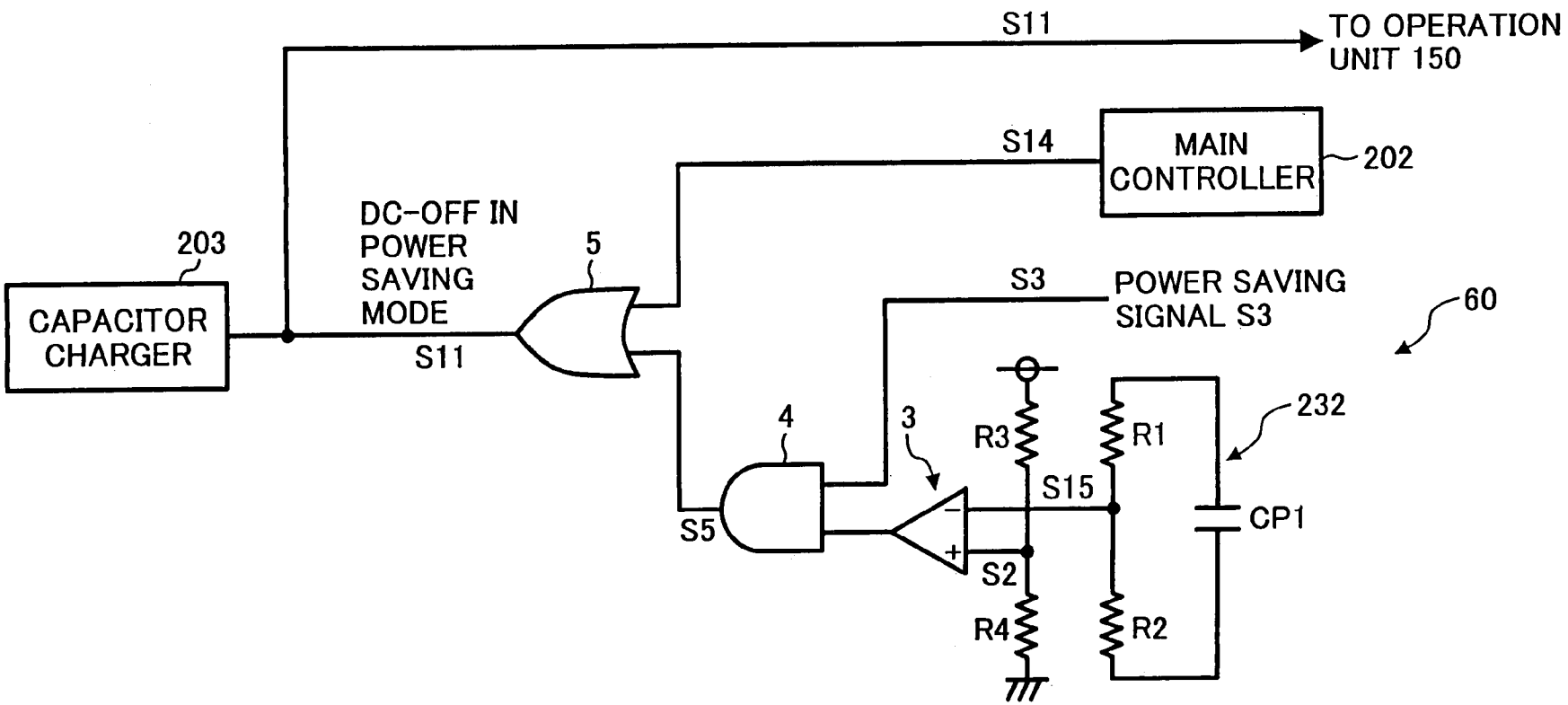
FIG. 14 is a circuit diagram of still another configuration of the charge control circuit.

FIG. 14 is a circuit diagram of still another configuration of the charge control circuit 10. The circuit elements of FIG. 14 having the same reference signs as these of FIG. 9 have the same functions as these of the charge control circuit 10 of FIG. 9, and detailed explanation thereof is omitted. A charge control circuit 60 of FIG. 14 is different from the charge control circuit 10 of FIG. 9 in that the control signal S11 is also output to the operation unit 150 based on the output signal of the AND circuit 4. With this arrangement, if the control signal S11 is in "H" level, the operation unit 150 can inform the user of execution of charging to the capacitor CP1 after the shift to the power saving mode using predetermined means such as lighting of a light emitting diode (LED) (informing unit).

Figure 15:
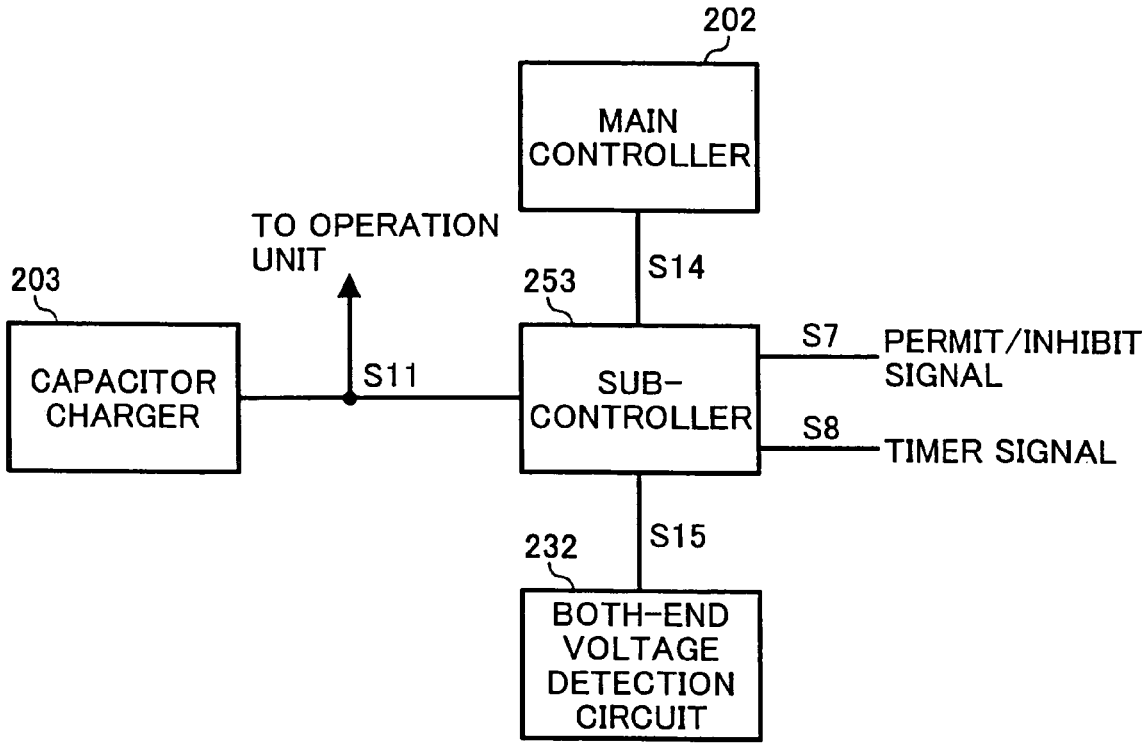
FIG. 15 is a circuit diagram when the functions of the charge control circuit are realized by the process executed by the sub-controller.

As another embodiment, a case where the functions of the charge control circuits 10 to 60 are realized by processes performed by another local controller, i.e., the sub-controller 253 in this example, is explained lower than. FIG. 15 is a block diagram of hardware in this case. In the following explanation, members having the same reference signs as these of FIG. 8 to FIG. 14 are the circuit elements as explained above, and therefore, detailed explanation thereof is omitted.

In this example, the main controller 202 outputs the control signal S14 to the sub-controller 253, and the sub-controller 253 controls the capacitor charger 203 to control the capacitor CP1 when the power saving mode is not active.

Figure 16:
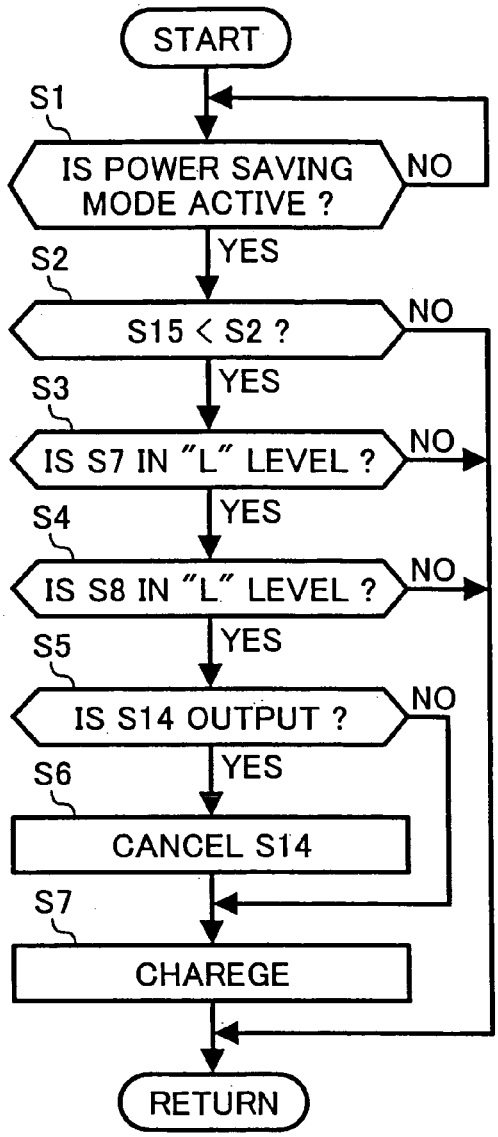
FIG. 16 is a flowchart of the process executed by the sub-controller.

Furthermore, the voltage detection signal S15, the permit/inhibit signal S7, and the timer signal S8 are also input to the sub-controller 253. When the power saving mode is active, the sub-controller 253 performs processes as shown in the flowchart of FIG. 16. The processes are performed to realize the charge controller. More specifically, if the power saving mode is active (Yes (Y) at step S1), the sub-controller 253 determines whether a voltage detection signal S15 indicating a terminal voltage of the capacitor CP1 is lower than a preset reference value S2 (step S2). If the voltage detection signal S15 is lower than the reference value S2 ("Y" at step S2), it is determined whether the permit/inhibit signal S7 and the timer signal S8 (in this example, the timer signal S8 is a signal in the sub-controller 253) are in "L" level (steps S3, S4). If both of the signals are in "L" level ("Y" at step S3, "Y" at step S4) and if the control signal S14 indicating an instruction to charge the capacitor CP1 is output from the controller 202 ("Y" at step S5), the control signal S14 is canceled (step S6), the control signal S11 is output to the capacitor charger 203, and the capacitor CP1 is charged (step S7). At step S7, the control signal S11 is also output to the operation unit 150, where it is informed to the user that the capacitor CP1 is charged, in the same manner as explained above with reference to FIG. 14 (informing unit).

If it is determined that the voltage detection signal S15 of the capacitor CP1 is not less than the reference value S2 (No (N) at step S2), or if both the permit/inhibit signal S7 and the timer signal S8 are in "H" level ("N" at step S3, "N" at step S4), charging at step S7 is not performed.

Figure 17:
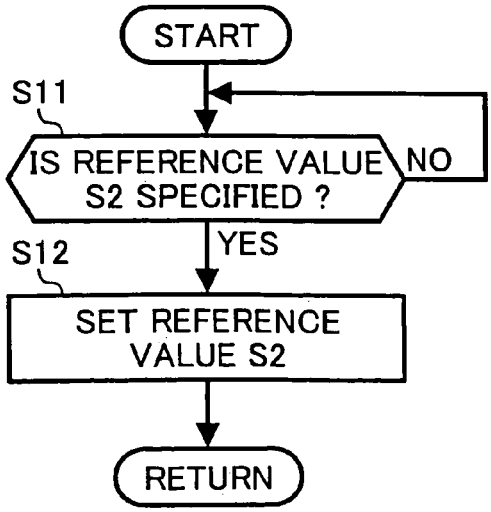
FIG. 17 is a flowchart of the process executed by the sub-controller.

FIG. 17 is a flowchart of the process of setting the reference value S2 executed by the sub-controller 253. More specifically, if a predetermined value is specified as the reference value S2 by operating a predetermined key in the operation unit 150 by a service person ("Y" at step S11), the sub-controller 253 sets the value as the reference value S2 in a nonvolatile memory (not shown) (variable unit) (step S12). In the process of FIG. 16, the determination at step S2 is performed using the reference value S2 set in the above manner.

By performing the processes, the local controller such as the sub-controller 253 can execute the functions of the charge control circuits 10 to 60.

A digital copying machine according to a second embodiment of the present invention is explained lower than. The digital copying machine according to the second embodiment has basically the same configuration as that of the digital copying machine according to the first embodiment as shown in FIG. 1 to FIG. 3. Therefore, only different portions are explained lower than.

Figure 18:
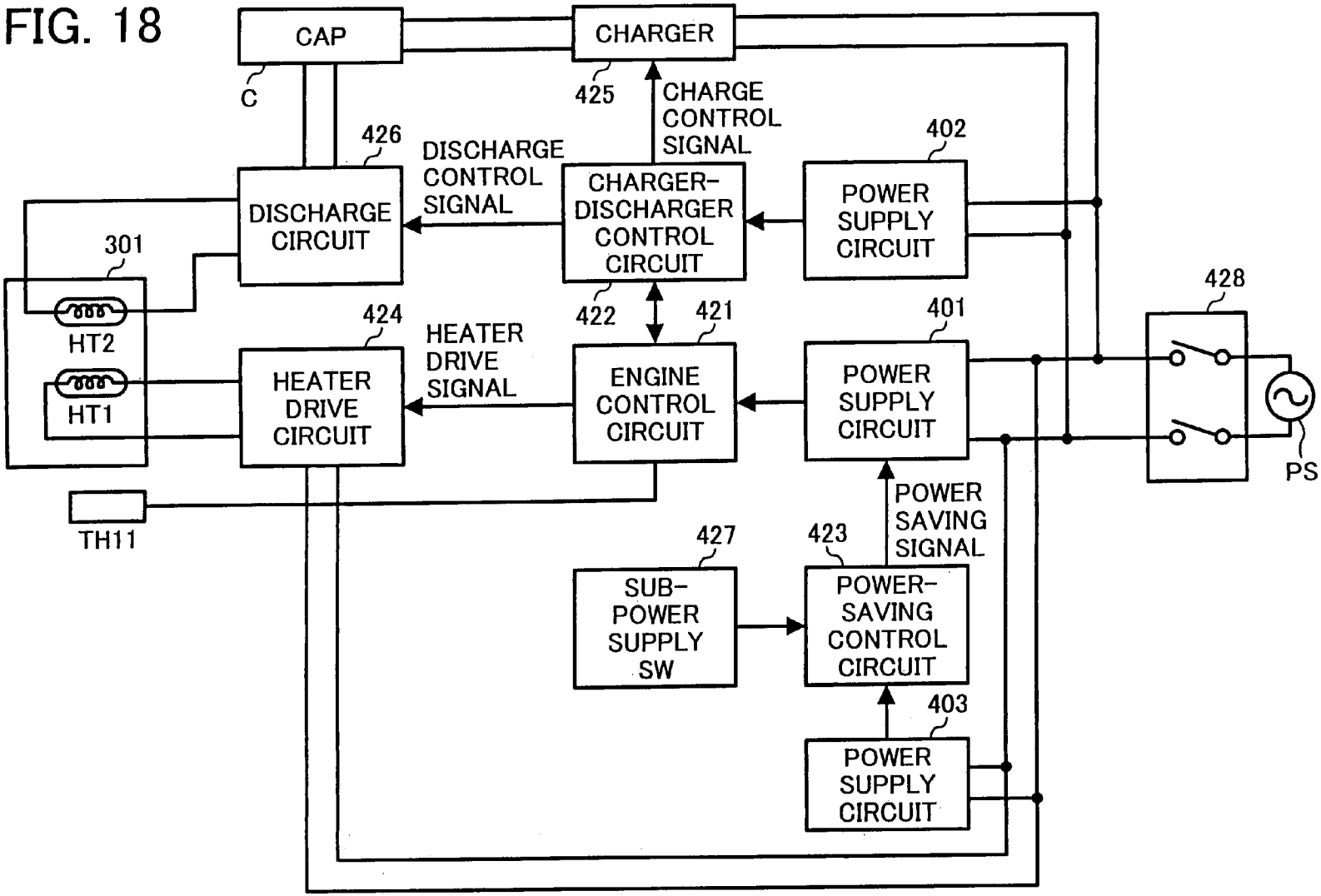
FIG. 18 is a circuit diagram of a power control system of a digital copying machine mainly including a fixing unit according to a second embodiment of the present invention.

FIG. 18 is a circuit diagram of a power control system of the digital copying machine 1 mainly including the fixing unit 121. The power control system as shown in FIG. 18 includes a main power supply SW 428 that turns on/off the power supply from the AC power supply (commercial AC power supply). When the main power supply SW 428 is turned on, power supply circuits 401, 402, and 403 are supplied with power from the AC power supply PS, and generate control power required for the fixing unit 121 and the like, respectively. In other words, the power supply circuit 401 supplies power to an engine control circuit 421 including the fixing unit 121. The power supply circuit 402 supplies power to a charger-discharger control circuit 422. The power supply circuit 403 supplies power to a power-saving control circuit 423.

In the second embodiment, a fixing heater HT1 as the first heating member is a main heater that is turned on when the temperature of the fixing roller 301 does not reach a predetermined target temperature Tt as a reference, and that heats the fixing roller 301. A fixing heater HT2 as the second heating member is an auxiliary heater that is turned on when the main power of the copying machine 1 is turned on or during a rising period from returning from the power saving mode to being ready for copying. In other words, the fixing heater HT2 is turned on when the fixing unit 121 is warmed up and heats the fixing roller 301.

The engine control circuit 421 includes a microcomputer, and controls the whole of the printer engine including the fixing unit 121 of the copying machine 1. A heater drive circuit 424 is supplied with power from the AC power supply PS, and supplies power to the fixing heater HT1. The power supply is controlled based on a heater drive signal output from the engine control circuit 421. Based on the control, the fixing heater HT1 is turned on when the temperature does not reach the predetermined target temperature Tt as the reference of the fixing roller 301 (the temperature of the fixing roller 301 is detected by the temperature sensor TH11), and heats the fixing roller 301.

A capacitor C that is an electric double layer capacitor is charged by a charger 425 supplied with power from the AC power supply PS. A discharge circuit 426 that is a discharger discharges charging power of the capacitor C, supplies power to the fixing heater HT2, and heats it. The charger 425 and the discharge circuit 426 are controlled by a charge control signal and a discharge control signal output of the charger-discharger control circuit 422 that includes a microcomputer. With the control, the fixing heater HT2 is energized when the main power to the copying machine 1 is turned on and during a rising period from returning from the power saving mode explained later to being ready for copying. In other words, the fixing heater HT2 is turned on when the fixing unit 121 is warmed up.

The power-saving control circuit 423 serves as a first control unit and includes a microcomputer. In the copying machine 1, the power-saving control circuit 423 manages controls of the power saving mode for the printer engine that includes the fixing unit 121 and for other loads. In other words, when predetermined conditions as explained lower than are continuous over a fixed time, a power supply to power loads is stopped, but some of the power loads such as the printer engine including the fixing unit 121 is continuously supplied with power. The conditions are such that an idling state, in which the main power supply SW 428 is on but image formation is not performed by the copying machine 1, is continuous over a fixed time, or that the user turns on a sub-power supply SW 427. If a predetermined condition is satisfied during the stop of the power supply, for example, if the user touches the operation panel (not shown) to operate the copying machine 1, the stop is released. In other words, the power supply circuit 401 supplies power to a large part of the power loads such as the engine control circuit 421 and the printer engine including the fixing unit 121. When receiving the power saving signal from the power-saving control circuit 423, the power supply circuit 401 is turned off and stops the power supply to the engine control circuit 421 and the other power loads. The power supply circuit 401 is turned on by the power saving signal from the power-saving control circuit 423, and restarts the power supply to the engine control circuit 421 and the other power loads.

In the above manner, even if the power supply circuit 401 is turned off by shifting to the power saving mode, the power-saving control circuit 423 can be supplied with power from the power supply circuit 403 separately from the power supply circuit 401. Therefore, the power-saving control circuit 423 has no obstacle in performing the control so that the mode of the power supply circuit 401 is returned from the power saving mode.

Furthermore, even if the power supply circuit 401 is turned off by shifting to the power saving mode, the charger-discharger control circuit 422 that is a second control unit can be supplied with power from the power supply circuit 402, separately from the power supply circuit 401. Therefore, the charger-discharger control circuit 422 continues operating even in the power saving mode and can perform charging and discharging on the capacitor C.

Figure 19:
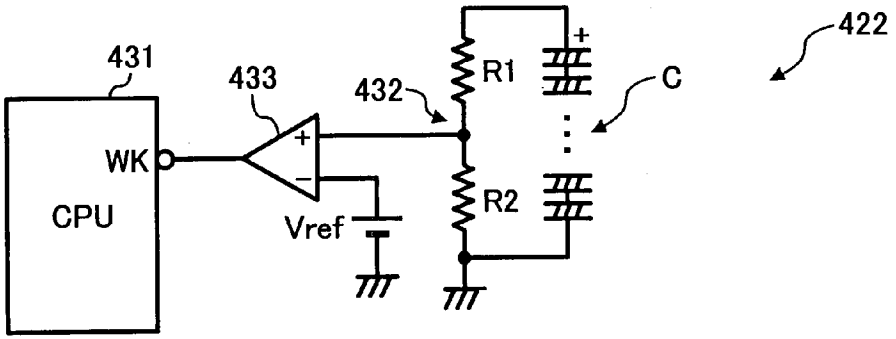
FIG. 19 is a circuit diagram of a charger-discharger control circuit according to the second embodiment.

The circuit configuration and the operation of the charger-discharger control circuit 422 are explained lower than. FIG. 19 is a circuit diagram for explaining the circuit configuration of the charger-discharger control circuit 422. The charger-discharger control circuit 422 includes a microcomputer 431. The capacitor C includes a voltage sensor 432 that divides a voltage between both ends of the capacitor C by the resistors R1 and R2 and detects the voltage to output a detection signal. A comparator 433 compares the detection signal with a predetermined reference voltage Vref. If the detection signal of the voltage is lower than the reference voltage Vref, the charger-discharger control circuit 422 outputs an "L" level signal to a wake up terminal WK of the microcomputer 431.

The contents of the control process executed by the charger-discharger control circuit 422 having the circuit configuration are explained lower than.

Figure 20:
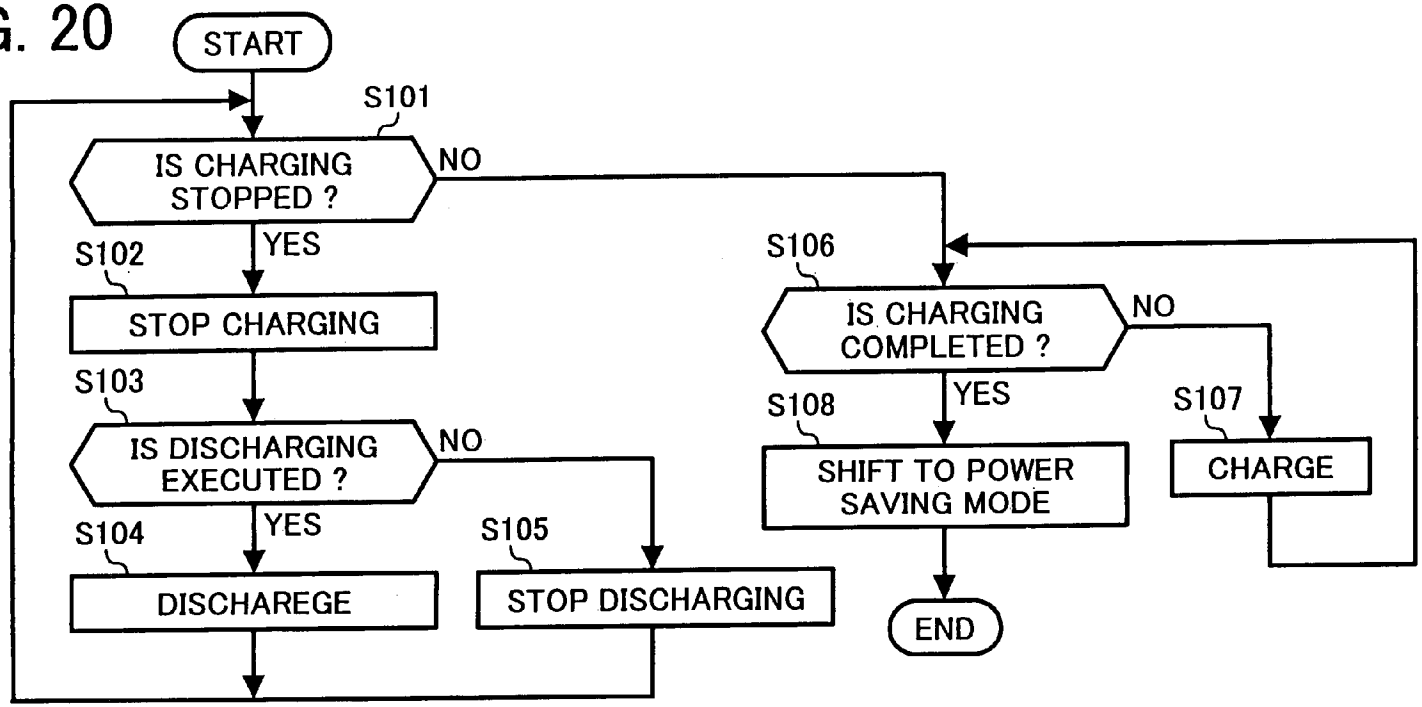
FIG. 20 is a flowchart of the process executed by the charger-discharger control circuit.

FIG. 20 is a flowchart of the process executed by the microcomputer 431 based on a predetermined control program. More specifically, in the copying machine 1, if an imaging operation of the printer engine is requested and the microcomputer 431 is about to stop charging ("Y" at step S101), the microcomputer 431 stops charging to the capacitor C by the charger 425 (step S102). When discharging is executed ("Y" at step S103), the discharge circuit 426 discharges the capacitor C (step S104). If discharging should not be performed ("N" at step S103), then the microcomputer 431 stops discharging of the capacitor C by the discharge circuit 426 (step S105).

If charging is not stopped ("N" at step S101), charging is continued ("N" at step S106, step S107) until charging to the capacitor C is completed (e.g. until the voltage detected by the voltage sensor 432 reaches a predetermined voltage value (the reference voltage Vref and so on) ("Y" at step S106). When charging is completed ("Y" at step S106), the microcomputer 431 shifts to the power saving mode (step S107), and basically stops the operation. In other words, the microcomputer 431 includes mode called power saving mode. In the power saving mode, if a predetermined condition is satisfied, in this example, if a charge control signal is not received (that is, when the imaging operation by the printer engine is not requested) and charging to the capacitor C is completed, a power supply to power loads is stopped, but the power supply to some of the power loads of the microcomputer 431 is continued. More specifically, the whole of the microcomputer 431 is stopped except for a part of the circuits including a circuit portion that receives an input to the wake up terminal.

Thereafter, if a predetermined condition is satisfied, i.e., if the terminal voltage of the capacitor C is lower than the reference voltage Vref because the state of power saving mode is continuous over a long time or natural discharge of the capacitor C occurs, the comparator 433 outputs the "L" level signal to the wake up terminal WK. By inputting the "L" level signal to the wake up terminal WK, a circuit portion of the microcomputer 431 that is operating even after the shift to the power saving mode activates the whole of the microcomputer 431, and shifts it to a normal mode. Therefore, after the activation, the process with reference to FIG. 19 is performed, and the capacitor C can be charged by the processes at step S107 and step S108 even if the terminal voltage of the capacitor C decreases caused by natural discharge of the capacitor C and so on.

Figure 21:
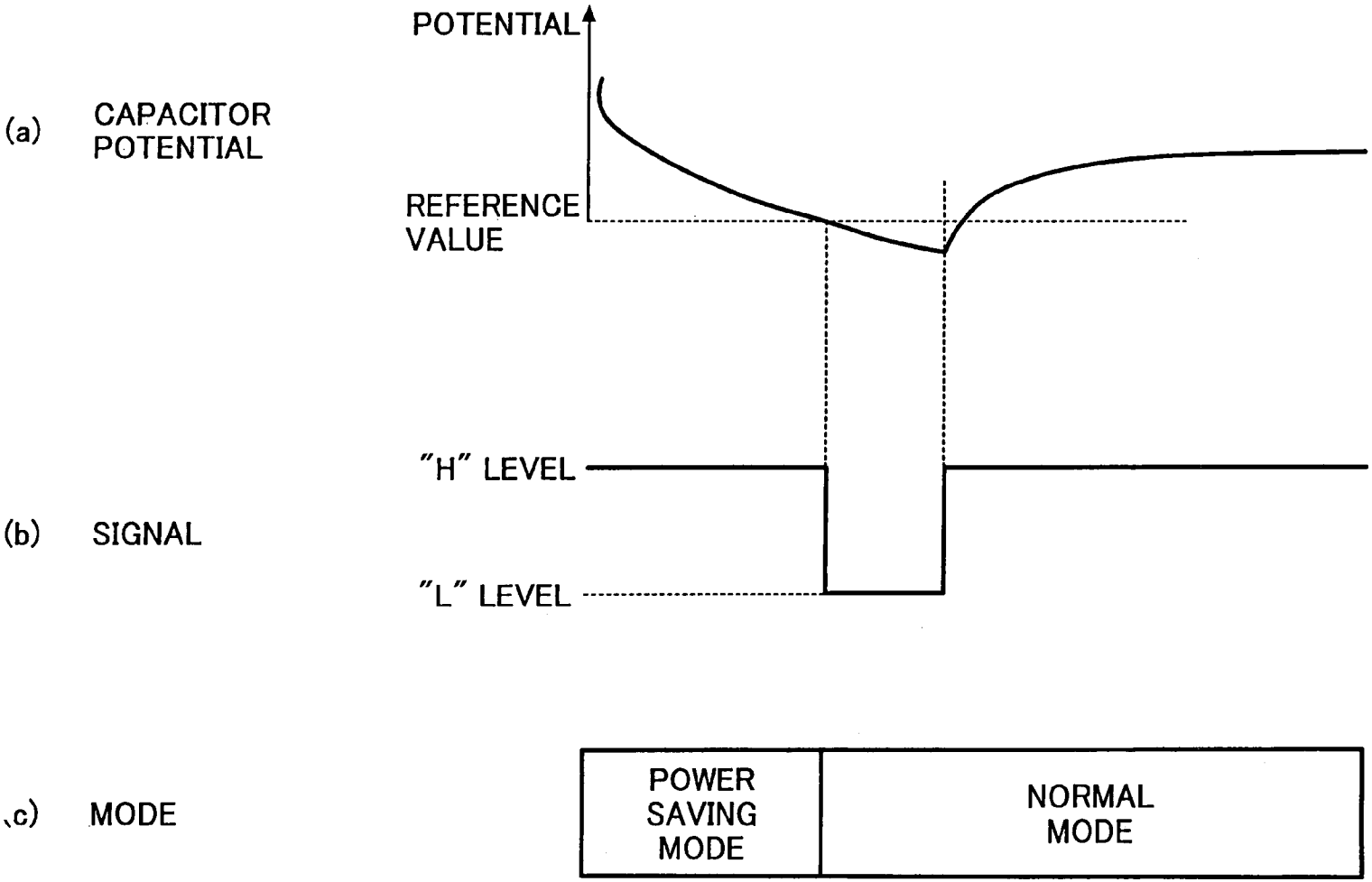
FIG. 21 is a timing chart for explaining an operation of the charger-discharger control circuit.

FIG. 21 is a timing chart for explaining the operation of the microcomputer 431 in this case. More specifically, if the mode of the microcomputer 431 is in the power saving mode ((c) of FIG. 21) and a terminal voltage of the capacitor decreases to be lower than the reference value as shown in (a) of FIG. 21, the level of a signal output from the comparator 433 changes from "H" level to "L" level ((b) of FIG. 21). The mode of the microcomputer 431 is returned to the normal mode (see (c) of FIG. 21) in which the whole of the microcomputer 431 is activated. Therefore, the terminal voltage of the capacitor C recovers to the reference value or more in a short time.

As explained above, the charger-discharger control circuit 422 can be supplied with power from the power supply circuit 402, independently from the load of the printer engine that is turned off in the power saving mode managed by the power-saving control circuit 423. Therefore, even in the power saving mode, it is possible to perform charging in the above manner if the terminal voltage of the capacitor C decreases, to sufficiently supply power from the capacitor C to the fixing heater HT2 right after the return from the power saving mode, and to quickly heat the fixing roller 301. Thus, the image formation can be started immediately even right after the return from the power saving mode without causing the user to wait.

In this case, in the charger-discharger control circuit 422, the mode shifts to the power saving mode, if charging is unnecessary, by the processes of FIG. 20. Therefore, the power is not used wastefully in the charger-discharger control circuit 422, which allows further power saving. In this case also, if the terminal voltage of the capacitor C decreases as shown in FIG. 21, the mode of the charger-discharger control circuit 422 is returned to the normal mode, and the capacitor C can be charged immediately. This allows a sufficient power supply to the fixing heater HT2 from the capacitor C even right after the return from the power saving mode, and therefore, the influence on the fixing heater HT2 is also a little.

A digital copying machine according to a third embodiment of the present invention is explained lower than. The digital copying machine according to the third embodiment has basically the same configuration as that of the digital copying machine according to the first embodiment as shown in FIG. 1 to FIG. 3, and only different portions are explained lower than.

Figure 22:
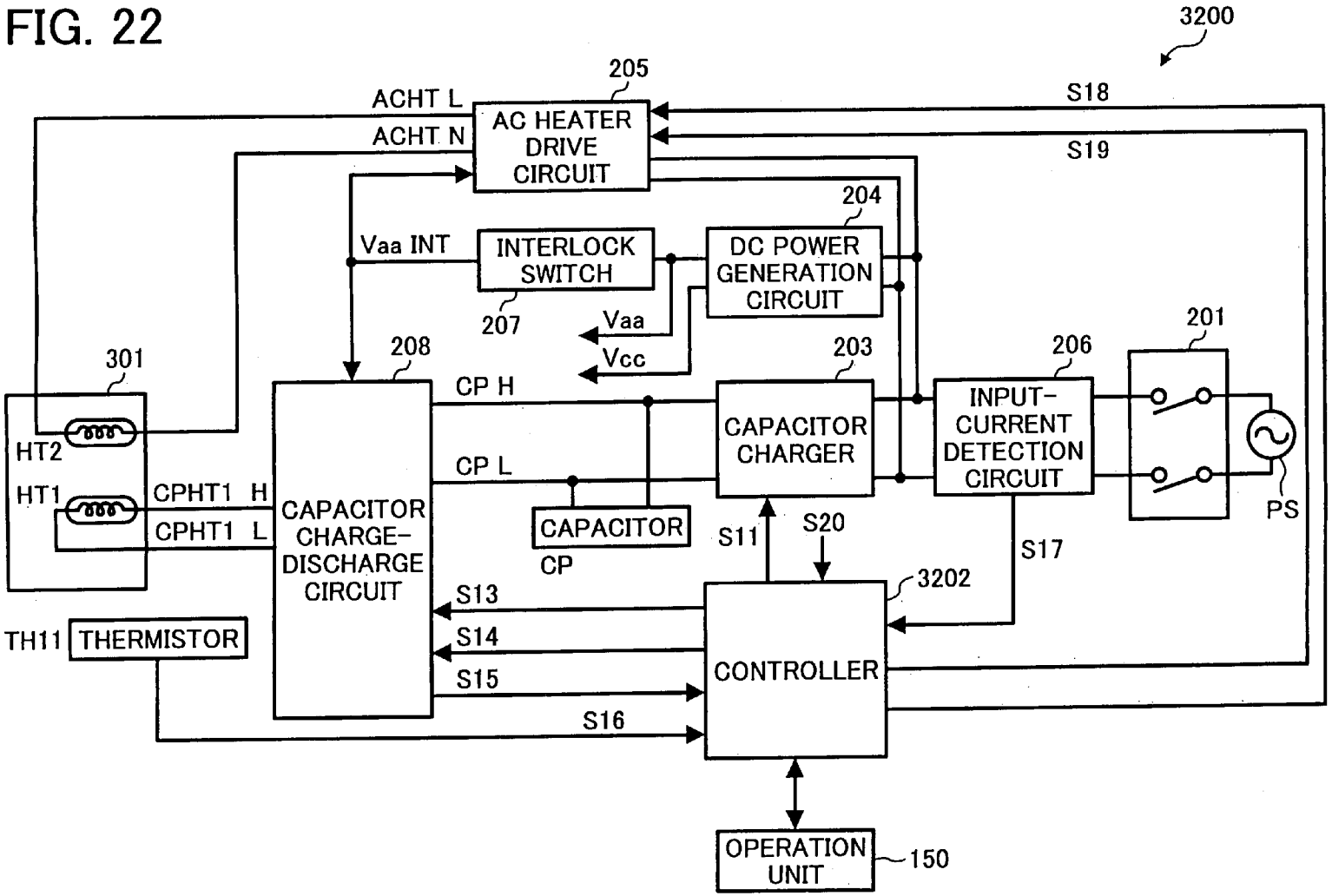
FIG. 22 is a circuit diagram of a power control system of a digital copying machine mainly including a fixing unit according to a third embodiment of the present invention.

FIG. 22 is a diagram of a configuration of a power control system of the copying machine 1 mainly including the fixing unit 121. The power control system includes the main power supply SW 201 that turns on/off a supply of power from the AC power supply (commercial power supply) PS, and the microcomputer. The power control system also includes a controller 3202 functioning also as a control unit that controls components of a power supply circuit 3200 and other parts, a capacitor CP that is an auxiliary power supply for the fixing heater HT1, and the capacitor charger 203 that serves as a charger for charging the capacitor CP. The power control system further includes the DC power generation circuit 204 that generates DC power for the copying machine 1, the AC-heater drive circuit 205 that supplies AC power to the fixing heater HT2, an input-current detection circuit 206 that detects a current input from the AC power supply PS, an interlock switch 207, and a capacitor charge-discharge circuit 208 that performs discharge of the capacitor CP and supplies DC power to the fixing heater HT1.

The AC power supply PS supplies AC power to the AC-heater drive circuit 205, the DC-power generation circuit 204, and the capacitor charger 203 through the main power supply SW 201 and the input-current detection circuit 206.

The controller 3202 mainly controls the components of the power supply circuit 3200, and controls the operations of the capacitor charger 203, the AC-heater drive circuit 205, and the capacitor charge-discharge circuit 208. More specifically, the controller 3202 outputs the control signal S11 to the capacitor charger 203 and controls the charging operation of the capacitor charger 203 to the capacitor CP. The controller 3202 outputs the control signals S13 and S14 to the capacitor charge-discharge circuit 208 and controls an on/off operation the capacitor charge-discharge circuit 208 to the fixing heater HT1. The controller 3202 also outputs the control signals S18 and S19 to the AC-heater drive circuit 205 and controls an on/off operation of the AC-heater drive circuit 205 to the fixing heater HT2.

The input-current detection circuit 206 is provided between the main power supply SW 201, the AC-heater drive circuit 205, the DC-power generation circuit 204, and the capacitor charger 203. The input-current detection circuit 206 detects an input current of AC power input through the main power supply SW 201, and outputs a current detection signal S17 to the controller 3202. The input current fluctuates according to each operating status of the AC-heater drive circuit 205, the DC-power generation circuit 204, the capacitor charger 203, and the image forming apparatus.

The DC-power generation circuit 204 generates power Vcc and power Vaa based on the AC power input through the main power supply SW 201, and outputs the power Vcc and the power Vaa to the components. The power Vcc is used mainly for the control system of the copying machine 1, and the power Vaa is used mainly for the drive system and high- and medium-voltage power supply.

The interlock switch 207 is a switch that is interlocked with a cover (not shown) or the like of the copying machine 1 to turn the power on/off. If the copying machine 1 includes a drive member and an application member for the high- and medium-voltage power that are able to be touched when the cover is opened, it is configured to cut off the power so as to stop the operation of the drive member or to stop applying a voltage to the application member when the cover is opened. A part of the power Vaa generated in the DC-power generation circuit 204 is input to the interlock switch 207, and is input to the capacitor charge-discharge circuit 208 and the AC-heater drive circuit 205 through the interlock switch 207.

The AC-heater drive circuit 205 turns on/off the fixing heater HT2 according to the control signals S18 and S19 input from the controller 3202.

The capacitor charger 203 is connected to the capacitor CP, and charges the capacitor CP based on the control signal S11 input from the controller 3202.

The capacitor CP is a capacitor with large capacity such as the electric double layer capacitor. The capacitor CP is connected to the capacitor charger 203 and the capacitor charge-discharge circuit 208. The capacitor CP is charged by the capacitor charger 203 and the power charged is supplied to the fixing heater HT1 under the on/off control of the capacitor charge-discharge circuit 208.

The capacitor charge-discharge circuit 208 discharges the power accumulated in the capacitor CP according to the control signals S13 and S14 input from the controller 3202, and turns on/off the fixing heater HT1.

The thermistor TH11 is provided near the fixing roller 301, and outputs the detection signal S16 corresponding to the surface temperature of the fixing roller 301, to the controller 3202. Since the resistance of the thermistor TH11 changes depending on temperature, the controller 3202 detects the surface temperature of the fixing roller 301 from the detection signal S16 based on the temperature-dependent change of the resistance.

Figure 23:
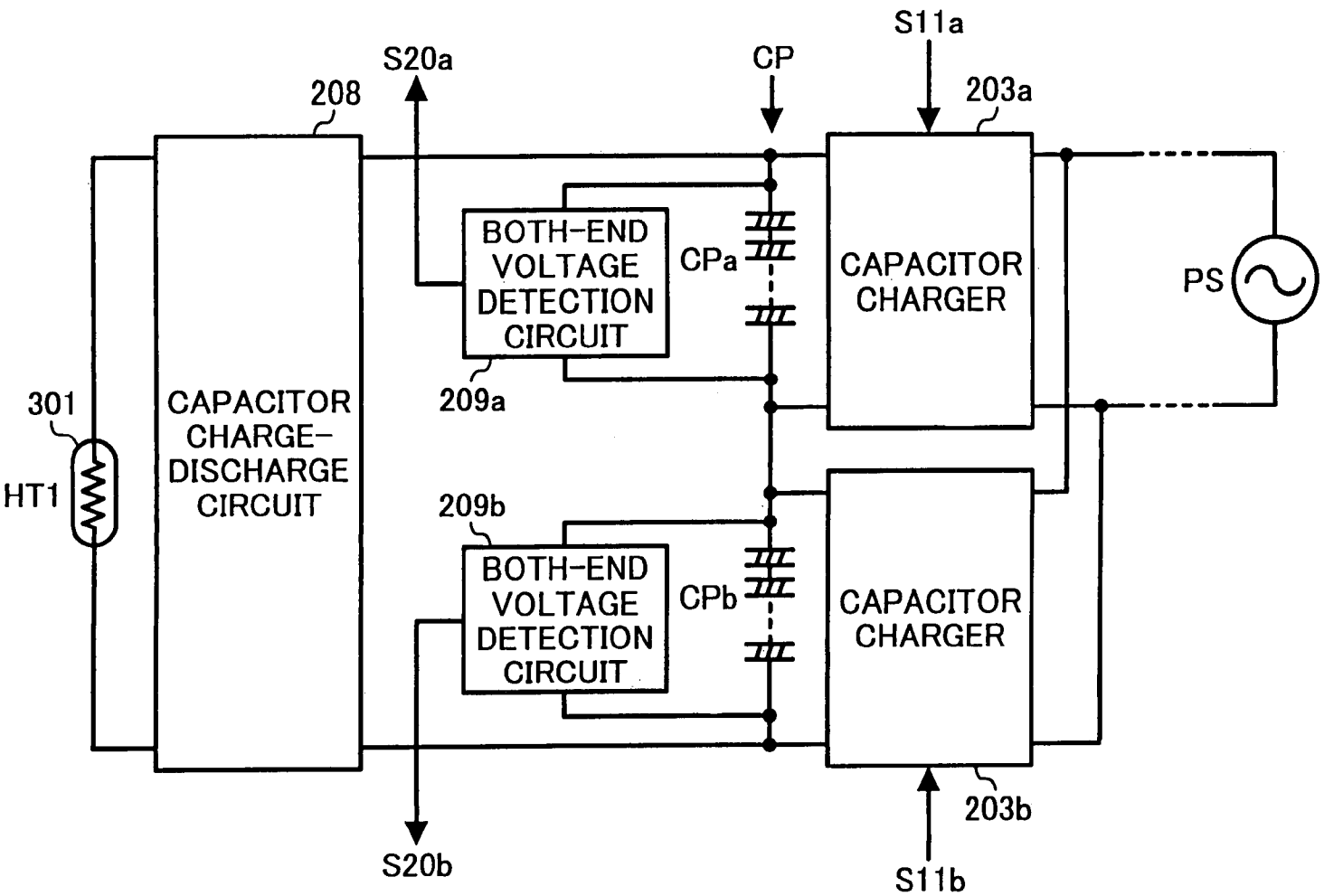
FIG. 23 is a circuit diagram of a configuration around an auxiliary power supply according to the third embodiment.

A configuration near the capacitor charger 203, the capacitor CP, and the controller 3202 that form an auxiliary power unit according to the third embodiment is shown in FIG. 23. In the third embodiment, the capacitor CP is formed not with a single capacitor but with a capacitor CPa as a first capacitor and a capacitor CPb as a second capacitor that are serially connected to each other. Each of the capacitor CPa and the capacitor CPb also includes a plurality of capacitors that are serially connected to each other. Each charging capacity (the number of capacitor cells) of these capacitors CPa and CPb may be different from each other, but the same charging capacity is preferable. The capacitor charger 203 includes a capacitor charger 203*a* (first charger) and a capacitor charger 203*b* (second charger), which are individually provided, corresponding to the capacitor CPa and the capacitor CPb, respectively. The capacitor chargers 203*a* and 203*b* are supplied with AC power from the AC power supply PS to charge the corresponding capacitors CPa and CPb. The controller 3202 outputs a control signal S11*a* and a control signal S11*b* as the control signal S11 to the capacitor chargers 203*a* and 203*b*, respectively, so as to enable individual control of the charging operation of the capacitor chargers 203*a* and 203*b* to the capacitors CPa and CPb.

Furthermore, a terminal voltage detection circuit (first terminal-voltage detection circuit) 209*a* and a terminal voltage detection circuit (second terminal-voltage detection circuit) 209*b* that detect each terminal voltage thereof are connected to the capacitors CPa and CPb. These terminal voltage detection circuits 209*a* and 209*b* output terminal voltages detected, as a voltage signal S20*a* and a voltage signal S20*b*, respectively, to the controller 3202.

Figure 24:
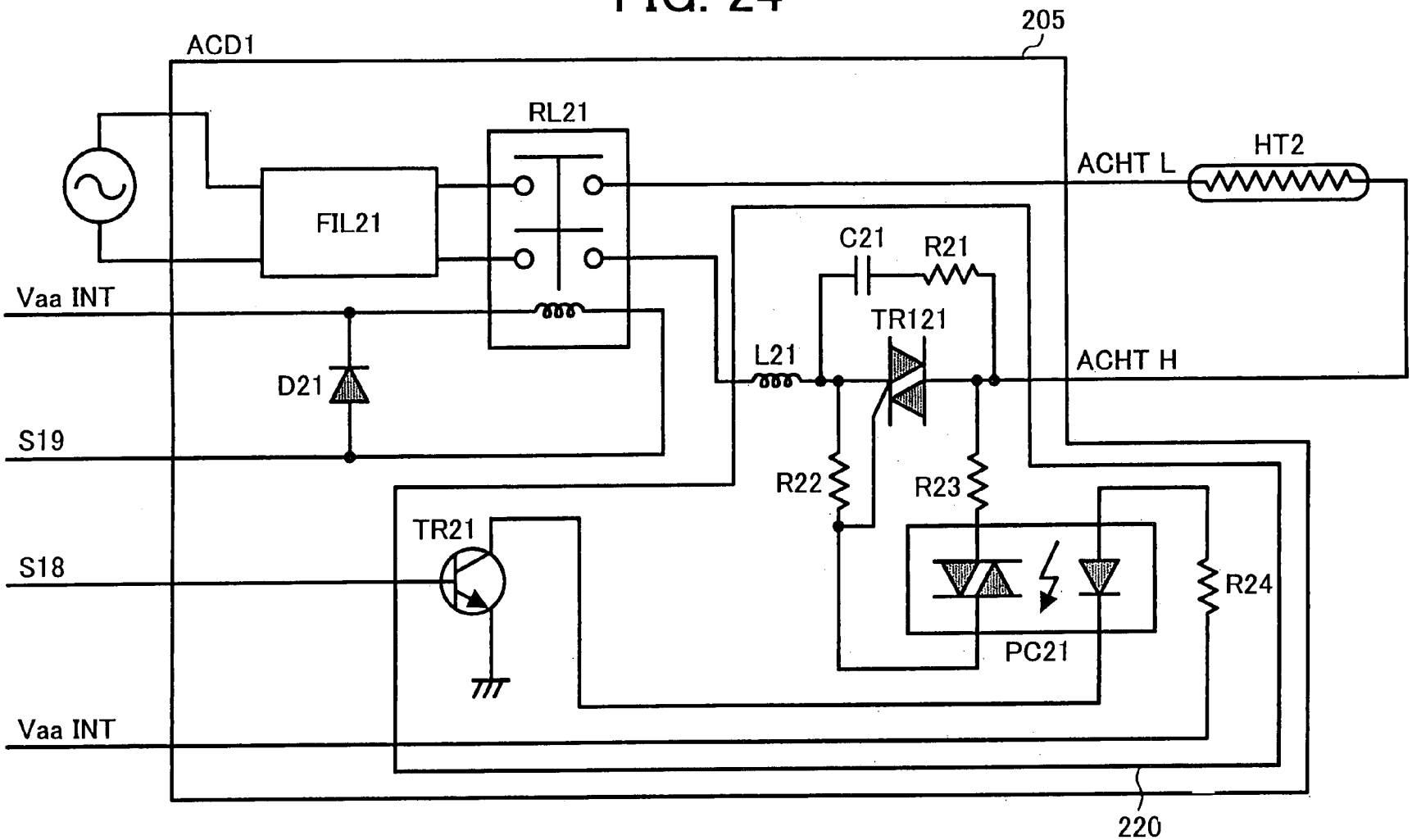
FIG. 24 is a circuit diagram of an AC heater drive circuit according to the third embodiment.

The AC-heater drive circuit 205 is explained lower than. FIG. 24 is a diagram of the configuration of the AC-heater drive circuit 205 of FIG. 22. The AC-heater drive circuit 205 includes the filter FIL21 that removes noise of the AC power input, the fixing relay RL21 for safety to be turned on/off according to the control signal S19 input from the controller 3202, the diode D21 for preventing counter electro-motive force of the fixing relay RL21, and the heater on/off circuit 220 that turns on/off the fixing heater HT2 based on the control signal S18 input from the controller 3202.

The AC power supply PS is connected to one end of the fixing heater HT2 through the filter FIL21 and the fixing relay RL21. The other end of the fixing heater HT2 is connected to the heater on/off circuit 220.

The heater on/off circuit 220 includes the triac TRI21 for turning on/off the AC power, the photocoupler PC21 for insulating a signal from the controller 3202 that is a secondary side, and the transistor TR21 for driving the LED on the light emission side of the photocoupler PC21. The heater on/off circuit 220 also includes the noise-absorption snubber circuit including the capacitor C21 and the resistor R21, the inductance L21 for noise absorption, the resistor R22 that is a resistor for preventing a dynamic current, and the resistors R23 and R24 that are resistors for restricting a current from the photocoupler PC21.

In the AC-heater drive circuit 205 configured as explained above, the fixing heater HT2 is supplied with power and is lit when both the fixing relay RL21 and the gate of the transistor TR21 are on.

The controller 3202 turns on/off the control signal S18 to be supplied to the gate of the transistor TR21 for the heater on/off circuit 220 in an on state of the control signal S19 that is supplied to the fixing relay RL21, and controls switching on/off of the fixing heater HT2.

Figure 25:
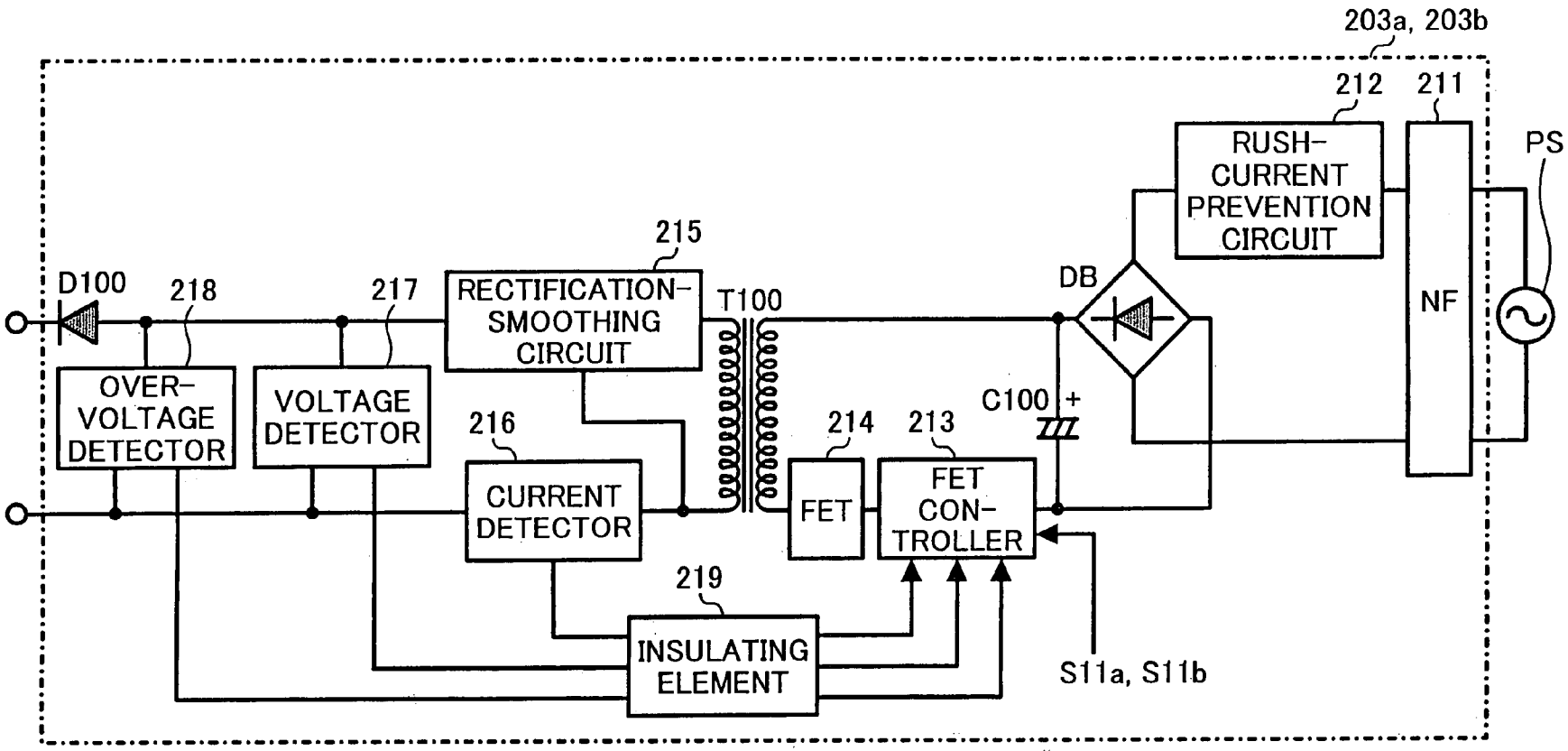
FIG. 25 is a circuit diagram of a capacitor charger according to the third embodiment.

FIG. 25 is a diagram of the configuration of the capacitor charger 203 of FIG. 22. Although the capacitor charger 203 includes the two capacitor chargers 203*a* and 203*b* as shown in FIG. 23, the two are shown in the figure in a shared form because they have the same configuration as each other. The capacitor charger 203*a* (or 203*b*) includes the noise filter (NF) 211 that removes noise of an AC voltage input, the rush-current prevention circuit 212 that prevents a rush current, the diode bridge DB that full-wave rectifies AC power from the AC power supply PS input through the rush-current prevention circuit 212, and the capacitor C100 that performs smoothing on the AC voltage full-wave rectified. The capacitor charger 203*a* (or 203*b*) also includes the FET controller 213 that controls switching of the FET 214 and controls the charging operation of the capacitor CPa (or CPb) (see FIG. 23), the FET 214 that turns on/off the trance T100, and the trance T100 that steps down a voltage input. The capacitor charger 203*a* (or 203*b*) further includes the rectification-smoothing circuit 215 that performs rectification and smoothing of an output on the secondary side of the trance T100 to be converted to a DC output, the current detector 216 that detects a current, the voltage detector 217 that detects a voltage, the overvoltage detector 218 that detects an overvoltage so as not to apply the overvoltage to the capacitor CPa (or CPb), the diode D100 for preventing a back flow from the capacitor CPa (or CPb), and the insulating element 219.

The AC voltage input from the AC power supply PS is noise-removed by the NF 211, is full-wave rectified by the diode bridge DB through the rush-current prevention circuit 212, and is subjected to smoothing by the capacitor C100 to obtain a DC voltage to be input to a primary side of the trance T100. If the control signal S11*a* (or S11*b*) input from the controller 3202 (see FIG. 22, FIG. 23) is "on", the FET controller 213 starts switching control of the FET 214 to charge the capacitor CPa (or CPb). The FET controller 213 controls switching of the FET 214 based on the respective detection signals input from the current detector 216, the voltage detector 217, and the overvoltage detector 218. The FET controller 213 performs constant current control, constant voltage control, or constant power control for charging the capacitor CPa (or CPb). Generally, the capacitor CPa (or CPb) is desired to be charged with the constant current. However, the capacitor CPa (or CPb) is charged by the constant power control to allow reduction in the charging time.

The trance T100 is turned on/off by the FET 214, and steps down a primary-side input to be output from the secondary side thereof. The secondary-side output of the trance T100 is subjected to rectification and smoothing in the rectification-smoothing circuit 215, and is output to the capacitor CPa (or CPb) through the diode D100. The current, the voltage, and the overvoltage of the secondary-side output of the trance T100 after rectification and smoothing are detected by the current detector 216, the voltage detector 217, and the overvoltage detector 218, respectively, and each detection signal is input to the FET controller 213.

Figure 26:
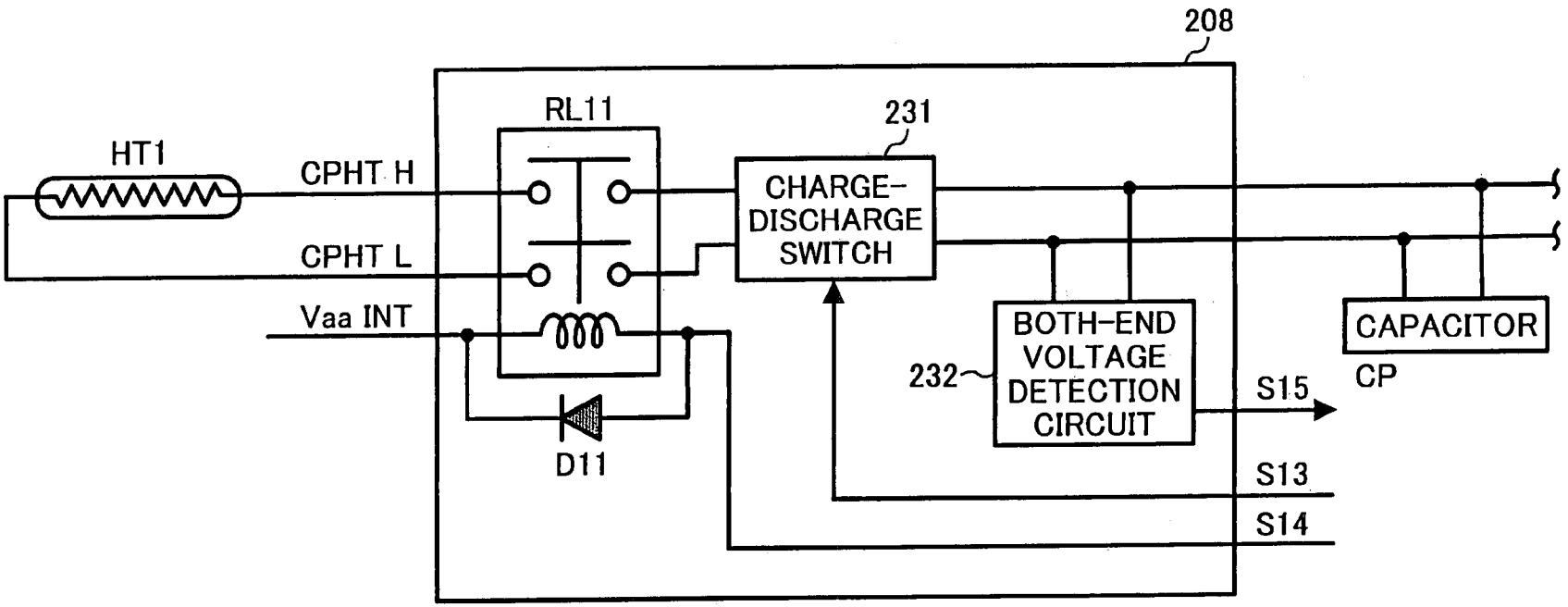
FIG. 26 is a circuit diagram of a capacitor charge-discharge circuit according to the first embodiment.

FIG. 26 is a diagram of the configuration of the capacitor charge-discharge circuit 208 of FIG. 22. The capacitor charge-discharge circuit 208 includes the charge-discharge switch 231, the fixing relay RL11 for safety, the diode D11 for preventing counter electro-motive force of the fixing relay RL11, and the terminal voltage detection circuit 232 that detects a terminal voltage of the whole capacitor CP.

Both ends of the capacitor CP are connected with the charge-discharge switch 231 and the fixing relay RL11. The charge-discharge switch 231 is turned on/off by the control signal S13 input from the controller 3202. Likewise, the fixing relay RL11 is turned on/off by the control signal S14 input from the controller 3202.

When both of the charge-discharge switch 231 and the fixing relay RL11 are turned on, charges accumulated in the capacitor CP are discharged to supply power to the fixing heater HT1.

The terminal voltage detection circuit 232 detects a terminal voltage of the capacitor CP and outputs the voltage detection signal S15 indicating the terminal voltage detected, to the controller 3202. The controller 3202 always monitors the voltage detection signal S15, and monitors how the capacitor CP is charged.

Figure 27:
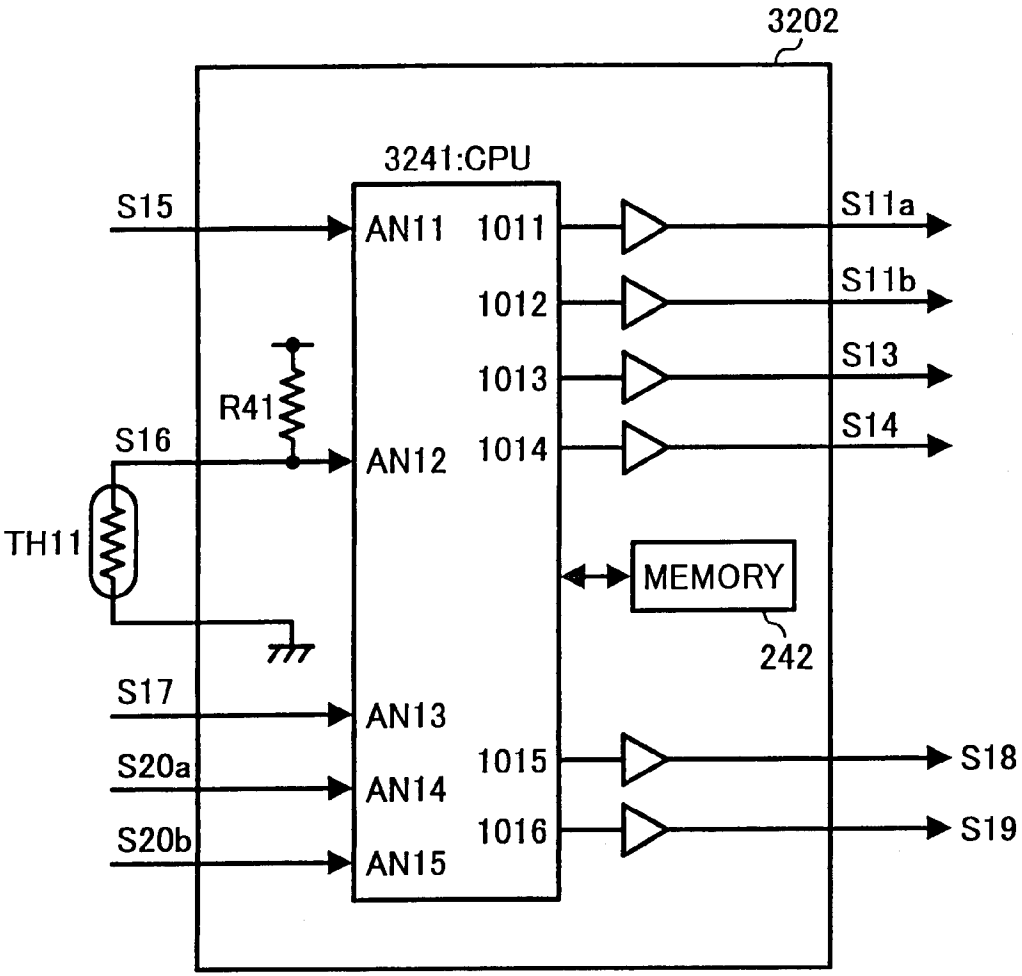
FIG. 27 is a circuit diagram of a controller according to the third embodiment.

FIG. 27 is a diagram of the schematic configuration of the controller 3202 of FIG. 22. The controller 3202 includes a CPU 3241 and the memory 242.

The CPU 3241 communicates with the memory 242 that stores a program to control the copying machine 1 and stores data, and controls the printer engine and the power supply circuit 3200 based on the program stored in the memory 242.

Input to the CPU 3241 are the voltage detection signal (analog signal) S15 indicating the terminal voltage of the capacitor CP detected by the terminal voltage detection circuit 232 of the capacitor charge-discharge circuit 208, the detection signal (analog signal) S16 indicating the voltage being divided by the resistance of the thermistor TH11 for detecting the surface temperature of the fixing roller 301 and the resistance of the resistor R41, the current detection signal (analog signal) S17 indicating an input current to the power supply circuit 403 detected by the input-current detecting circuit 206, and a voltage signal S20*a* and a voltage signal S20*b* indicating each terminal voltage of the capacitors CPa and CPb detected by the terminal voltage detection circuits 209*a* and 209*b*, respectively. These signals are input to the CPU 3241 through AN ports AN11 to AN15.

The CPU 3241 outputs, through 10 ports 1011 to 1016, the control signal S11*a* and the control signal S11*b* for causing charging of the capacitors CPa and CPb to be turned on/off, the control signal S13 for causing the charge-discharge switch 231 to be turned on/off, the control signal S14 for causing the fixing relay RL11 to be turned on/off, the control signal S18 for causing the heater on/off circuit 220 to be turned on/off, and the control signal S19 for causing the fixing relay RL21 to be turned on/off (see also FIG. 22, FIG. 23, and FIG. 25).

In the above configuration, basically, the fixing heater HT2 is turned on when the temperature of the fixing roller 301 does not reach a predetermined target temperature Tt as a reference of the fixing roller 301, and heats the fixing roller 301. Furthermore, the fixing heater HT1 that uses the capacitor CP as an auxiliary heater is also turned on when the main power to the copying machine 1 is turned on or during a rising period from returning from the power saving mode to being ready for copying. In other words, the fixing heater HT1 is turned on when the fixing unit 121 is warmed up, and heats the fixing roller 301. As explained above, by using the capacitor CP such as the electric double layer capacitor as the auxiliary power supply, even if the power supply from the AC power supply PS to the fixing unit 121 is insufficient, a large current can be instantly supplied to the fixing unit 121. Therefore, it is possible to prevent deterioration of fixability due to insufficient power. However, after the capacitor CP discharges to supply power to the fixing roller 301, it is necessary to charge the capacitor CP at a predetermined timing.

Figure 28:
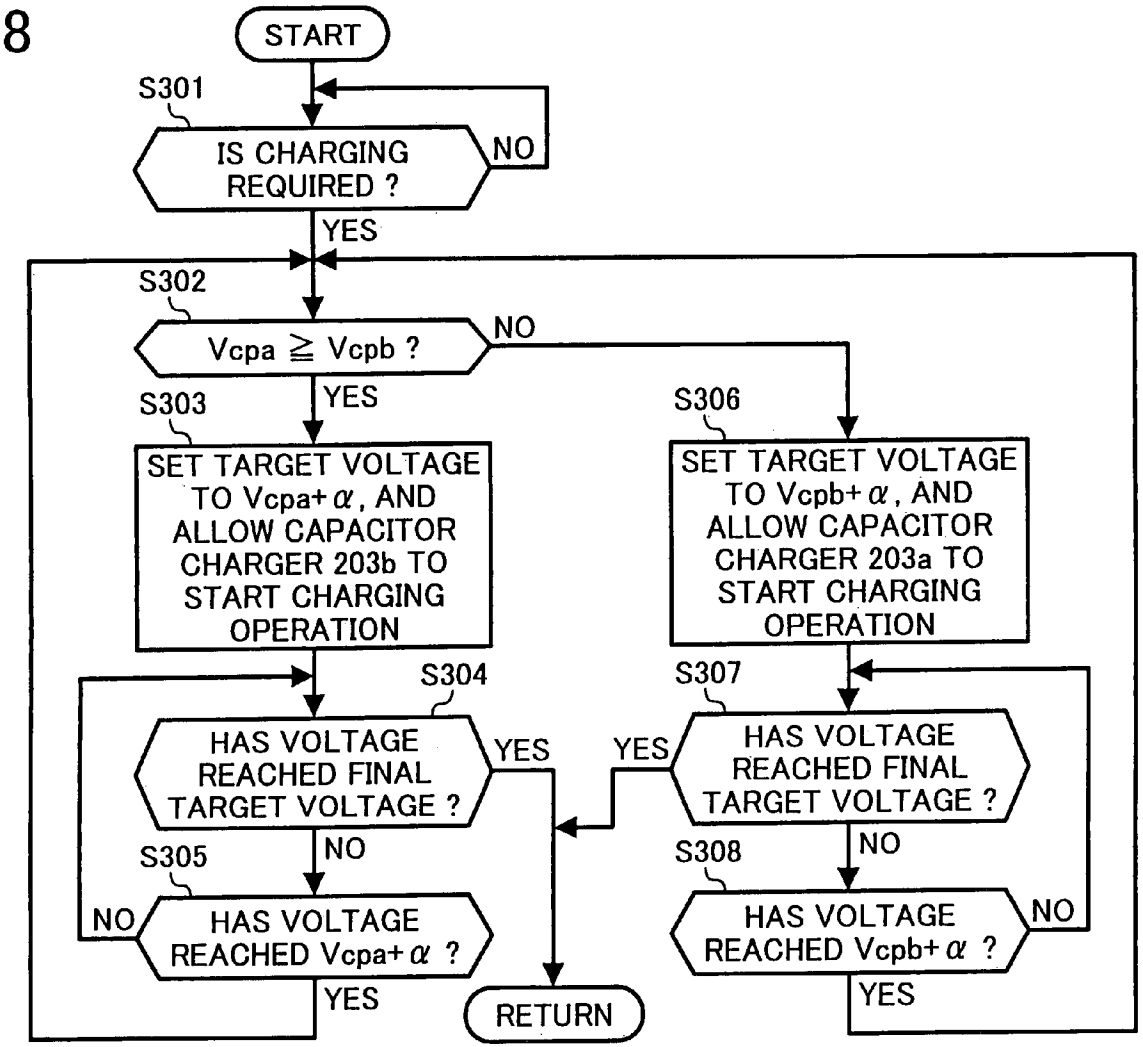
FIG. 28 is a flowchart of an example of controlling a charging operation according to the third embodiment.

A control example of the charging operation to the capacitor CP (CPa, CPb) by the capacitor chargers 203*a* and 203*b* according to the third embodiment is explained lower than with reference to a schematic flowchart of FIG. 28. The charging operation is executed under the control of the CPU 3241. Basically, the charging operation to the capacitor CP is executed when the terminal voltage of the whole capacitor CP decreases lower than a predetermined voltage. It is determined whether the capacitor CP needs charging by monitoring the voltage detection signal S15 from the terminal voltage detection circuit 232 (step S301). If it is determined by the voltage detection signal S15 that the terminal voltage of the capacitor CP is lower than the predetermined voltage and charging is needed ("Y" at step S301), it is compared whether the voltage signal S20*a* is greater than the voltage signal S20*b* (step S302). The voltage signals S20*a* and S20*b* are obtained from the terminal voltage detection circuits 209*a* and 209*b* that detect each initial terminal voltage of the capacitors CPa and CPb upon the start of the charging operation. Here, the terminal voltage of the capacitor CPa is indicated by Vcpa and the terminal voltage of the capacitor CPb is indicated by Vcpb.

As a result of comparison, if Vcpa≧Vcpb ("Y" at step S302), the control signal S11*b* indicating that the charging operation is allowed to be on is output to the capacitor charger 203*b* corresponding to the capacitor CPb of which terminal voltage is lower, and the capacitor charger 203*b* starts charging the capacitor CPb (step S303). At this time, a target voltage during this charging operation is set to Vcpa+α. More specifically, the target voltage is a voltage that exceeds the terminal voltage Vcpa that is higher, i.e., a voltage that increases by an amount of a defined voltage α preset with respect to the terminal voltage Vcpa. At this time, the control signal S11*a* output to the capacitor charger 203*a* indicates that the charging operation is off, and accordingly the capacitor charger 203*a* does not charge the capacitor CPa. During this charging operation, it is monitored whether the terminal voltage Vcpb detected by the terminal voltage detection circuit 209*b* has reached the final target voltage preset (e.g. 45 volts) (step S304). If it has not reached the final target voltage preset ("N" at step S304), it is checked whether it has reached this target voltage Vcpa+α (step S305). If it has reached the target voltage Vcpa+α ("Y" at step S305), then the process returns to step S302.

As a result of comparison, if Vcpa≧Vcpb is not satisfied ("N" at step S302), the control signal S11*a* indicating that the charging operation is allowed to be on is output to the capacitor charger 203*a* corresponding to the capacitor CPa of which terminal voltage is lower, and the capacitor charger 203*a* starts charging the capacitor CPa (step S306). A target voltage during the charging operation in this case is set to Vcpb+α. More specifically, the target voltage is a voltage that exceeds the terminal voltage Vcpb that is higher, i.e., a voltage that increases by an amount of a defined voltage α preset with respect to the terminal voltage Vcpb. At this time, the control signal S11*b* output to the capacitor charger 203*b* indicates that the charging operation is off, and accordingly the capacitor charger 203*b* does not charge the capacitor CPb. During this charging operation, it is monitored whether the terminal voltage Vcpa detected by the terminal voltage detection circuit 209*a* has reached a final target voltage preset (e.g. 45 volts) (step S307). If it has not reached the final target voltage preset ("N" at step S307), it is checked whether it has reached this target voltage Vcpb+α (step S308). If it has reached the target voltage Vcpb+α ("Y" at step S308), then the process returns to step S302.

The operations thereafter are executed as follows. If "Y" at step S305, then the process returns to step S302, at which Vcpa≧Vcpb is not satisfied this time, and the process proceeds along the routine of the N side at step S302. If "Y" at step S308, the process returns to step S302, at which Vcpa≧Vcpb is satisfied this time, and the process proceeds along the routine of the Y side at step S302. If one of the voltages Vcpa and Vcpb has reached the final target voltage ("Y" at step S304, or "Y" at step S307), the process returns to step S301. If one of the voltages has not reached the final target voltage, the charging operation is still needed ("Y" at step S308), and the process is executed along either one of the routine on the Y side at step S302 and the routine on the N side at step S302. The charging operation is finished finally at the point in time when the terminal voltages Vcpa and Vcpb have reached the final target voltages.

Figure 29:
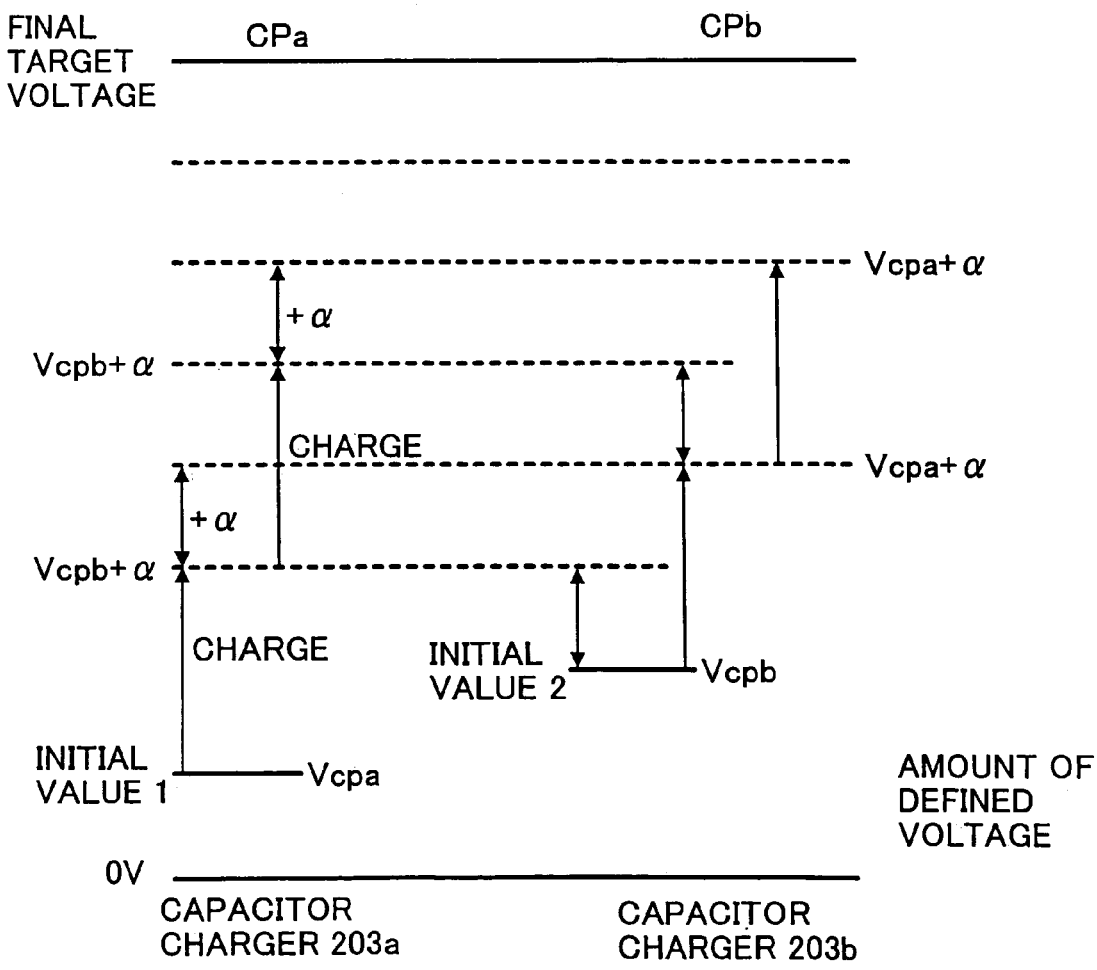
FIG. 29 is a diagram for explaining an example of switching control.

FIG. 29 is a diagram for explaining an example of switching control for the charging operation of the capacitor chargers 203*a* and 203*b*. For initial terminal voltages, the Vcpa side is lower in FIG. 29.

In the third embodiment, during the charging operation to the capacitor CP, switching is controlled for the charging operation between the capacitor chargers 203*a* and 203*b* based on the result of detection (voltage signals S20*a* and S20*b*) of the terminal voltage detection circuits 209*a* and 209*b* under the control of the CPU 3241. In the third embodiment in particular, the charging operation is started from the capacitor charger 203*a* or 203*b* corresponding to a lower initial terminal voltage. With this configuration, the switching is controlled so that the charging operations are alternately performed between the capacitor charger 203*a* and the capacitor charger 203*b*. In this manner, a charging voltage (e.g. 90 volts) required as the capacitor CP can be ensured as a total charging voltage of the capacitors CPa and CPb. However, because the capacitors CPa and CPb have the capacitor chargers 203*a* and 203*b*, respectively, charging is performed by switching between the charging operations by the capacitor chargers 203*a* and 203*b*. This allows the charging operation to be performed by a smaller power supply as compared with that when a single 90V-capacitor is charged by a single charger. As a result, even if the power supplied from the AC power supply PS is limited during copying, the capacitor CP can be charged efficiently.

When switching is controlled so that the charging operations are alternately performed, it is controlled so that a lower terminal voltage increases by an amount of a defined voltage α with respect to a higher terminal voltage. Therefore, a big difference does not occur between the terminal voltages of the two capacitors CPa and CPb, and a well-balanced charging operation is performed. The defined voltage α in this case is set preferably to a voltage not more than a reverse breakdown voltage (normally, about 1.2 volts) per capacitor cell for the capacitors serially connected to each other forming each of the capacitors CPa and CPb. By using such a defined voltage α, a reverse voltage is not applied from one side to the other, which allows performance of extremely well-balanced charging operation in which voltages are balanced between the two capacitors CPa and CPb.

Figure 30A:
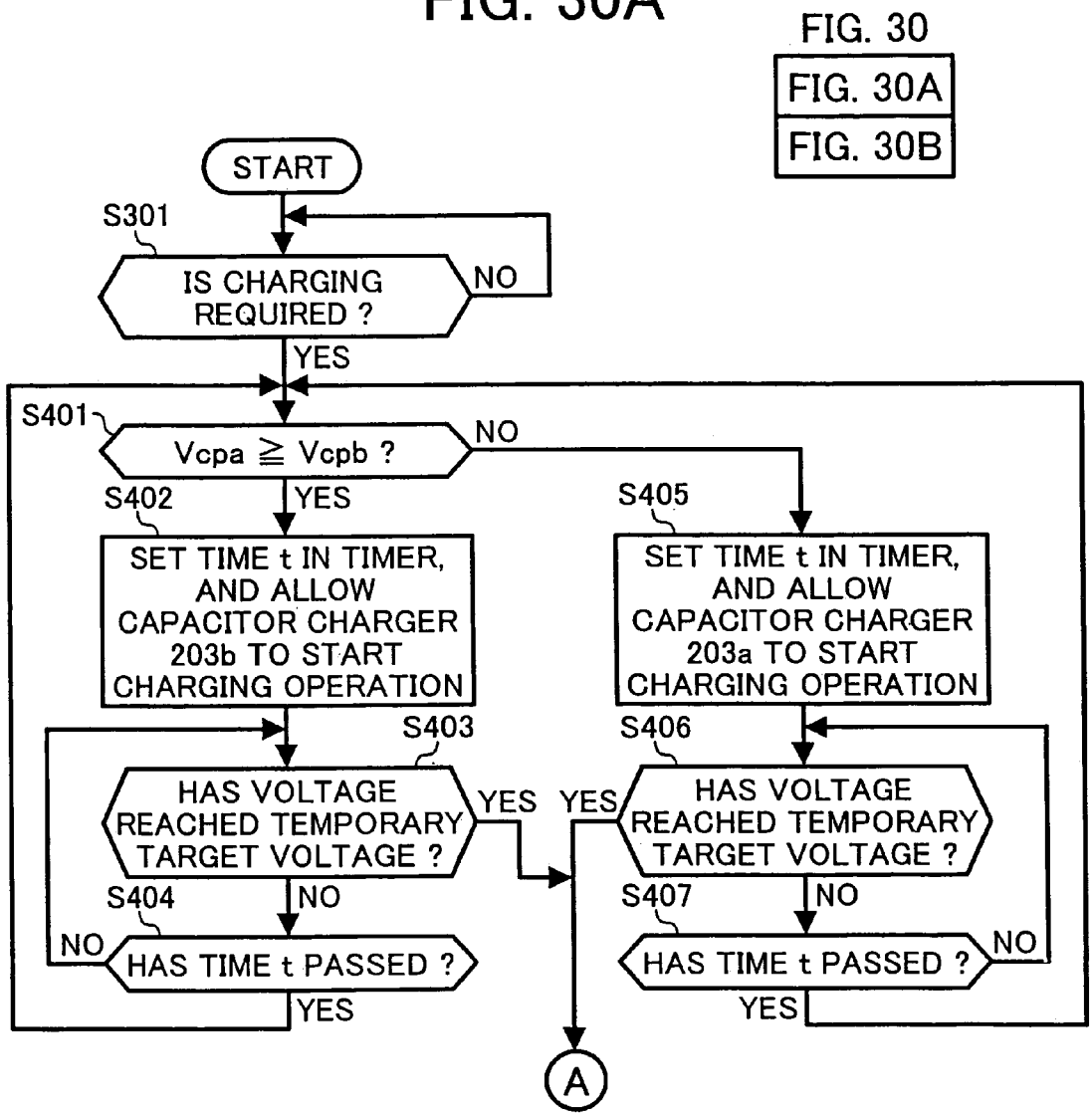
FIG. 30 is a flowchart of an example of controlling a charging operation according to a fourth embodiment of the present invention.
Figure 30B:
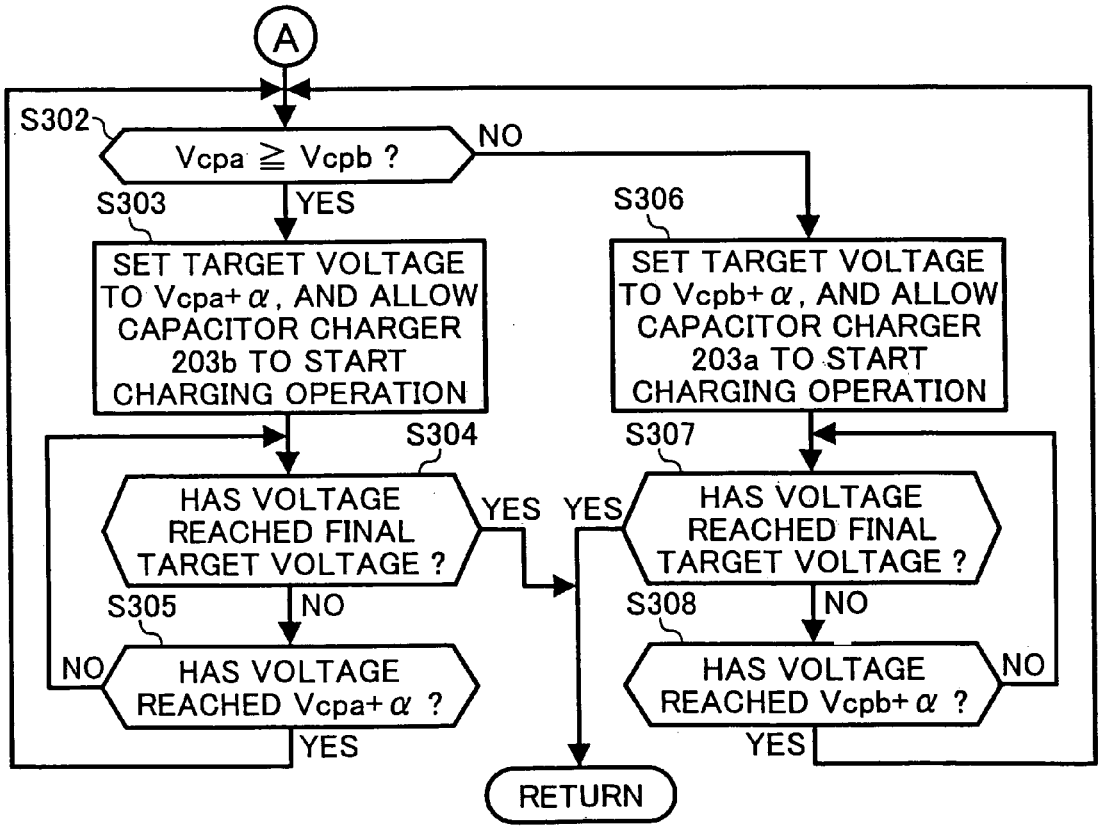

A fourth embodiment of the present invention is explained lower than with reference to FIG. 30. Portions of FIG. 30 corresponding to these of the third embodiment are assigned with the same reference signs as these of the third embodiment, and explanation thereof is omitted (the same goes for an embodiment explained later).

The charging operations of the capacitor chargers 203*a* and 203*b* in the fourth embodiment are controlled following the case of the first embodiment basically, but the time controlled by a timer is added to the first half of alternate switching control for the charging operation. A timer built in the CPU 3241 is used here.

FIG. 30 is a schematic flowchart of an example of controlling the charging operation of the capacitor chargers 203*a* and 203*b* according to the fourth embodiment. A temporary target voltage (e.g. 40 volts) is preset to a voltage lower than a final target voltage (e.g. 45 volts).

The charging operation to the capacitor CP is executed when the terminal voltage of the whole capacitor CP decreases lower than a predetermined voltage, and it is determined whether charging is needed by monitoring the voltage detection signal S15 from the terminal voltage detection circuit 232 (step S301). If it is determined from the voltage detection signal S15 that the terminal voltage of the capacitor CP is lower than the predetermined voltage and charging is needed ("Y" at step S301), then it is compared which is higher between an initial voltage signal S20*a* (Vcpa) and an initial voltage signal S20*b* (Vcpb) upon the start of the charging operation, the voltage signals being obtained from the terminal voltage detection circuits 209*a* and 209*b*, respectively (step S401).

As a result of comparison, if Vcpa≧Vcpb ("Y" at step S401), the control signal S11*b* indicating that the charging operation is allowed to be on is output to the capacitor charger 203*b* corresponding to the capacitor CPb of which terminal voltage is lower, and the capacitor charger 203*b* starts charging the capacitor CPb (step S402). At this time, a fixed time t for performing the charging operation is set in the timer. The fixed time t is desirably set so that the charging operation for the fixed time t allows the terminal voltage to exceed the higher terminal voltage Vcpa. At this time, the control signal S11*a* output to the capacitor charger 203*a* indicates that the charging operation is off, and accordingly the capacitor charger 203*a* does not charge the capacitor CPa. During this charging operation, it is monitored whether the terminal voltage Vcpb detected by the terminal voltage detection circuit 209*b* has reached the temporary target voltage preset (e.g. 40 volts) (step S403). If it has not reached the temporary target voltage ("N" at step S403), it is checked whether this set time t has passed (step S404). If the set time t has passed ("Y" at step S404), then the process returns to step S401.

As a result of comparison, if Vcpa≧Vcpb is not satisfied ("N" at step S401), the control signal S11*a* indicating that the charging operation is allowed to be on is output to the capacitor charger 203*a* corresponding to the capacitor CPa of which terminal voltage is lower, and the capacitor charger 203*a* starts charging the capacitor CPa (step S405). A fixed time t for performing the charging operation is set in the timer. The fixed time t is desirably set so that the charging operation for the fixed time t allows the terminal voltage to exceed the higher terminal voltage Vcpb. At this time, the control signal S11*b* output to the capacitor charger 203*b* indicates that the charging operation is off, and accordingly the capacitor charger 203*b* does not charge the capacitor CPb. During this charging operation, it is monitored whether the terminal voltage Vcpa detected by the terminal voltage detection circuit 209*a* has reached the temporary target voltage preset (e.g. 40 volts) (step S406). If it has not reached the temporary target voltage ("N" at step S406), it is checked whether this set time t has passed (step S407). If the set time t has passed ("Y" at step S407), then the process returns to step S401.

The operations thereafter are executed as follows. If "Y" at step S404, then the process returns to step S401 at which Vcpa≧Vcpb is not satisfied this time, and the process proceeds along the routine of the N side at step S401. If "Y" at step S407, the process returns to step S401 at which Vcpa≧Vcpb is satisfied this time, and the process proceeds along the routine of the Y side at step S401.

If one of the voltages Vcpa and Vcpb has reached the temporary target voltage ("Y" at step S403, or "Y" at step S406), the process returns to step S302 as shown in FIG. 28, and the alternate switching control is executed in the above manner.

In the fourth embodiment, the switching control can be performed before the voltage has reached the temporary target voltage lower than the final target voltage so that the charging operation is alternately performed by the capacitor chargers 203*a* and 203*b* under the control of the timer. Thus, high speed processing is achieved.

Figure 31:
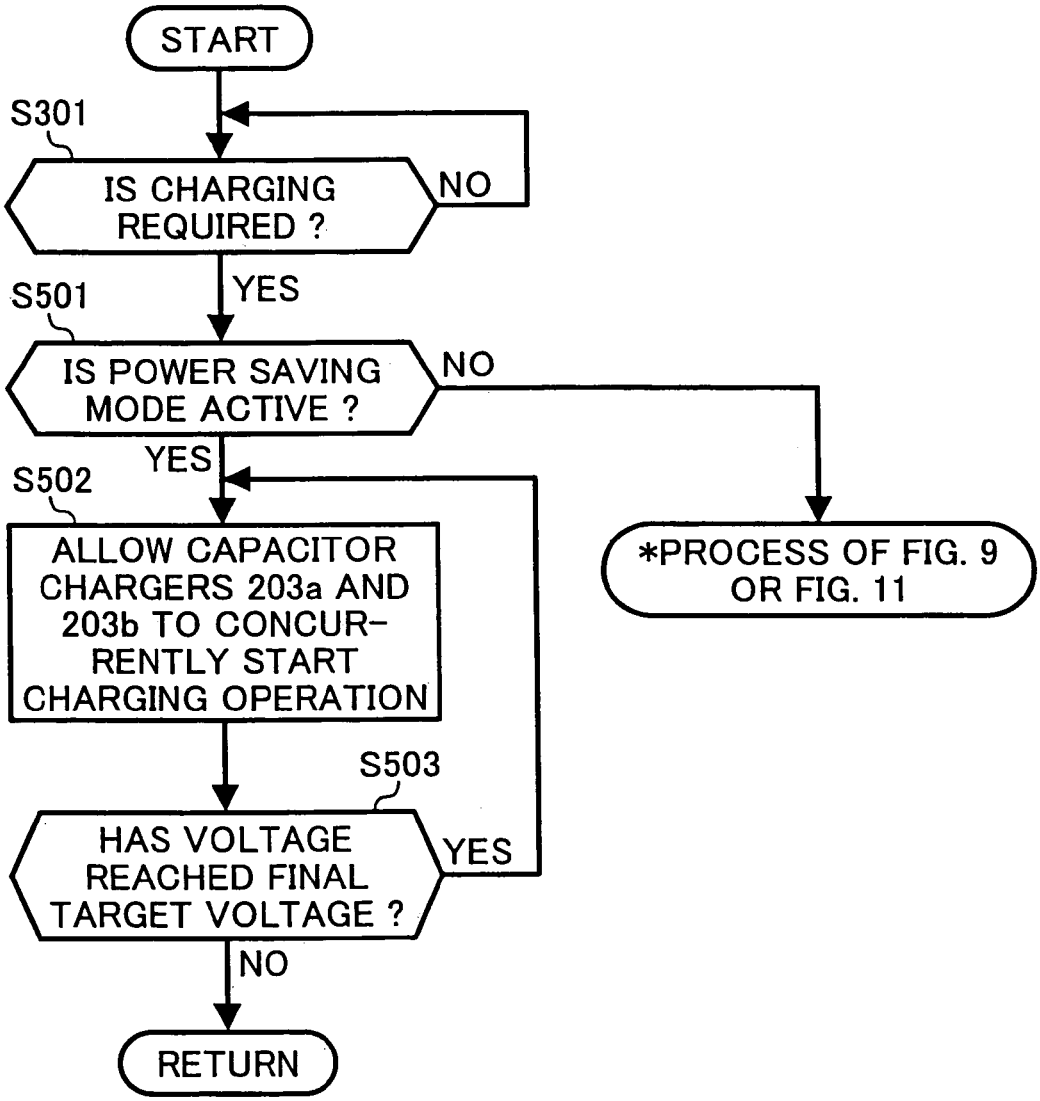
FIG. 31 is a flowchart of an example of controlling a charging operation according to a fifth embodiment of the present invention.

A fifth embodiment of the present invention is explained lower than with reference to FIG. 31. The fifth embodiment is an example applied to the copying machine 1 having the so-called power saving mode.

A copying machine 1 according to the fifth embodiment includes a function of the power saving mode. More specifically, the copying machine 1 includes a function of achieving power saving and energy saving if a predetermined condition is satisfied, i.e., if a fixed time passes while the copying machine 1 is in a standby state in which it is not used. The function is realized by maintaining a power supply only to a part of power loads and stopping the power supply to almost all parts of the power loads. This function is such that when the predetermined condition is satisfied after the stop of the power supply to the large parts of power loads, or when the predetermined condition is satisfied, that is, when the user touches an operation key of the operation unit (not shown), the power supply to the power loads to which the power supply has been stopped is re-started (power controller). However, this function is well known, and therefore, drawing and explanation thereof are omitted. A return condition, as another condition, from the power saving mode may include detection of a document that is set on the document table 102, detection of FAX reception when the copying machine 1 includes the FAX transmitting/receiving function, and detection of reception of a printer job.

In such a power saving mode, there are cases where the charge amount of the capacitor CP is insufficient when shifting to the power saving mode or after the shift. More specifically, the cases are such that the charge amount of the capacitor CP is insufficient upon shifting to the power saving mode or the time for the power saving mode is continuous over a long time and natural discharge of the capacitor CP occurs. In such cases, even if the mode is returned from the power saving mode and an image is to be formed in the copying machine 1, it is impossible to immediately heat the fixing roller 301, and the start of the image formation is delayed. As a result, the user has to wait for starting of the image formation for a long time. Therefore, even in the power saving mode, the charging operation to the capacitor CP needs to be performed if charging is required.

The fifth embodiment is provided to explain the control example of the charging operation by the capacitor chargers 203 (203*a* and 203*b*) when the copying machine 1 has the power saving mode. The schematic control example is shown in the flowchart of FIG. 31.

The charging operation to the capacitor CP is executed in the above manner when the terminal voltage of the whole capacitor CP decreases lower than a predetermined voltage. It is determined whether the capacitor CP needs charging by monitoring the voltage detection signal S15 from the terminal voltage detection circuit 232 (step S301). If it is determined by the voltage detection signal S15 that the terminal voltage of the capacitor CP is lower than the predetermined voltage and charging is needed ("Y" at step S301), it is determined whether the copying machine 1 is in the power saving mode (step S502). If it is in any mode other than the power saving mode ("N" at step S501), the alternate switching control is executed (e.g. controls after step S302 of FIG. 28 and after step S401 of FIG. 30).

On the other hand, if the copying machine 1 is in the power saving mode ("Y" at step S501), the control signals S11*a* and S11*b* indicating that the charging operation is allowed to be on are simultaneously output to the capacitor chargers 203*a* and 203*b*, and the capacitor chargers 203*a* and 203*b* start charging the capacitors CPa and CPb, respectively (step S502). During this charging operation, it is monitored whether the terminal voltages Vcpa and Vcpb detected by the terminal voltage detection circuits 209*a* and 209*b* have reached the final target voltages preset (e.g. 45 volts) (step S503). If they have not reached the final target voltages preset ("N" at step S503), the charging operations are continued until they have reached the final target voltages, and then the process returns to step S501.

In the fifth embodiment, the CPU 3241 controls switching so that the capacitor chargers 203*a* and 203*b* are allowed to concurrently perform the charging operations in the power saving mode, and that the capacitor chargers 203*a* and 203*b* are allowed to alternately perform the charging operation in any other mode.

The power saving mode is provided to achieve power saving effect in a standby state in which the copying machine 1 is not used, and even if an image is formed in the power saving mode, the operation is not affected by the power saving mode. Therefore, even if all the power supplied from the AC power supply PS is spent for the charging operation to the capacitor CP (CPa, CPb), no trouble occurs in terms of the power. Further, if the capacitor chargers 203*a* and 203*b* concurrently perform the charging operations, the charging operations to the capacitors CPa and CPb can be finished in a short time. Thus, it is also possible to return any mode to the original power saving mode in a short time.

According to one aspect of the present invention, the power saving mode is controlled in the following manner. if a predetermined condition is satisfied, a power supply to a part of power loads of the power controller, including the control unit that controls charging to the capacitor, is stopped. If a predetermined condition is satisfied during the stop of the power supply, the stop is released. By executing the control, the capacitor can be charged even if the power is not supplied to the control unit. Therefore, even right after the return from the power saving mode, it is possible to immediately increase a heat temperature of the heating member using a sufficient charging power of the capacitor.

According to another aspect of the present invention, the power saving mode is controlled in the following manner. If a predetermined condition is satisfied, the power supply to power loads except for a part of the power loads of the heating unit is stopped. If a predetermined condition is satisfied during the stop of the power supply, the stop (e.g. the power saving mode) is released. Even if the control is executed, a power supply to the second control unit is maintained independently from the control. Therefore, it is possible to charge the capacitor even if the power loads of the heating unit is stopped by the control.

According to still another aspect of the present invention, the capacitor includes the first capacitor and the second capacitor serially connected to each other. A charging voltage required as the capacitor can be ensured as a total charging voltage of these capacitors. Moreover, because the first and the second capacitors include the first charger and the second charger, respectively, by switching between the charging operations by the first and the second chargers, the charging operation can be performed with a smaller amount of power supply as compared with the case where a single capacitor is charged by a single charger. Thus, it is possible to efficiently charge the capacitor even if power to be supplied from the commercial power supply is limited during copying operation.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A heating unit comprising:

a capacitor;

a charger that charges the capacitor;

a heating member that produces heat with a supply of a charging power from the capacitor;

a terminal-voltage detecting circuit that detects a terminal voltage of the capacitor;

a control unit that controls the charger based on the terminal voltage detected to charge the capacitor;

a power controller that stops, when a predetermined condition is satisfied, a power supply to a part of power loads of the heating unit including the control unit, and releases, when a predetermined condition is satisfied during a stop state of the power supply, the stop state; and a charge controller that controls, during the stop state of the power supply, the charger to charge the capacitor based on the terminal voltage detected.

2. The heating unit according to claim 1, wherein the control unit and the charge controller controls the charger to charge the capacitor when the terminal voltage detected is lower than a predetermined value.

3. The heating unit according to claim 1, further comprising an instruction receiving unit that receives an instruction to inhibit charging of the capacitor from a user, wherein the charge controller inhibits the charging of the capacitor when the instruction receiving unit receives the instruction.

4. The heating unit according to claim 3, further comprising a time determining unit that determines whether a current time is in a predetermined time window, wherein the charge controller inhibits the charging of the capacitor when the instruction receiving unit receives the instruction, if the time determining unit determines that the current time is in the predetermined time window.

5. The heating unit according to claim 1, further comprising an informing unit that informs a user of charging the capacitor when the capacitor is charged by the charge controller.

6. The heating unit according to claim 1, wherein the control unit controls the charger to charge the capacitor when the terminal voltage detected is lower than a predetermined value, and the charge controller includes a comparator circuit that compares the terminal voltage detected with the predetermined value, and outputs a first signal when the terminal voltage detected is lower than the predetermined value; and an AND circuit that takes a logical product of the first signal output from the comparator circuit and a second signal indicating that the power supply is stopped.

7. The heating unit according to claim 6, further comprising an instruction receiving unit that receives an instruction to inhibit charging of the capacitor from a user, wherein the AND circuit takes the logical product of the first signal, the second signal, and a third signal indicating that the instruction receiving unit received the instruction.

8. The heating unit according to claim 6, further comprising a time determining unit that determines whether a current time is in a predetermined time window, wherein the AND circuit takes a logical product of the first signal, the second signal, and a fourth signal indicating that the time determining unit determined that the current time is in the predetermined time window.

9. The heating unit according to claim 6, further comprising an informing unit that informs a user of charging the capacitor when the capacitor is charged by the charge controller based on an output signal from the AND circuit.

10. A fixing unit comprising:

a fixing member that applies pressure and heat to a medium, on which a toner image is formed, to fix the toner image on the medium;

a capacitor;

a charger that charges the capacitor with a supply of power from a commercial power supply;

a heating member that produces heat with a supply of charging power from the capacitor;

a terminal-voltage detecting circuit that detects a terminal voltage of the capacitor;

a control unit that controls the charger based on the terminal voltage detected to charge the capacitor;

a power controller that stops, when a predetermined condition is satisfied, a power supply to a part of power loads of the heating unit including the control unit, and releases, when a predetermined condition is satisfied during a stop state of the power supply, the stop state; and a charge controller that controls, during the stop state of the power supply, the charger to charge the capacitor based on the terminal voltage detected.

11. The fixing unit according to claim 10, wherein the control unit and the charge controller controls the charger to charge the capacitor when the terminal voltage detected is lower than a predetermined value.

12. The fixing unit according to claim 10, further comprising an instruction receiving unit that receives an instruction to inhibit charging of the capacitor from a user, wherein the charge controller inhibits the charging of the capacitor when the instruction receiving unit receives the instruction.

13. The fixing unit according to claim 12, further comprising a time determining unit that determines whether a current time is in a predetermined time window, wherein the charge controller inhibits the charging of the capacitor when the instruction receiving unit receives the instruction, if the time determining unit determines that the current time is in the predetermined time window.

14. The fixing unit according to claim 10, further comprising an informing unit that informs a user of charging the capacitor when the capacitor is charged by the charge controller.

15. The fixing unit according to claim 10, wherein the control unit controls the charger to charge the capacitor when the terminal voltage detected is lower than a predetermined value, and the charge controller includes a comparator circuit that compares the terminal voltage detected with the predetermined value, and outputs a first signal when the terminal voltage detected is lower than the predetermined value; and an AND circuit that takes a logical product of the first signal output from the comparator circuit and a second signal indicating that the power supply is stopped.

16. The fixing unit according to claim 15, further comprising an instruction receiving unit that receives an instruction to inhibit charging of the capacitor from a user, wherein the AND circuit takes the logical product of the first signal, the second signal, and a third signal indicating that the instruction receiving unit received the instruction.

17. The fixing unit according to claim 15, further comprising a time determining unit that determines whether a current time is in a predetermined time window, wherein the AND circuit takes a logical product of the first signal, the second signal, and a fourth signal indicating that the time determining unit determined that the current time is in the predetermined time window.

18. The fixing unit according to claim 15, further comprising an informing unit that informs a user of charging the capacitor when the capacitor is charged by the charge controller based on an output signal from the AND circuit.

19. An image forming apparatus that forms an image on a medium using an electrophotographic method, the image forming apparatus comprising a fixing unit that includes a fixing member that applies pressure and heat to a medium, on which a toner image is formed, to fix the toner image on the medium;

a capacitor;

a charger that charges the capacitor with a supply of power from a commercial power supply;

a heating member that produces heat with a supply of charging power from the, capacitor;

a terminal-voltage detecting circuit that detects a terminal voltage of the capacitor;

a control unit that controls the charger based on the terminal voltage detected to charge the capacitor;

a power controller that stops, when a predetermined condition is satisfied, a power supply to a part of power loads of the heating unit including the control unit, and releases, when a predetermined condition is satisfied during a stop state of the power supply, the stop state; and a charge controller that controls, during the stop state of the power supply, the charger to charge the capacitor based on the terminal voltage detected.

20. A heating unit comprising:

a capacitor;

a charger that charges the capacitor;

a heating member;

a discharger that discharges charging power of the capacitor to the heating member to make the heating member produce heat;

a first control unit that stops, when a predetermined condition is satisfied, a power supply to other power loads except for a part of power loads of the heating unit, and releases, when the predetermined condition is satisfied during a stop state of the power supply, the stop state; and a second control unit that is driven with a supply of power independently from the first control unit, and controls charging of the capacitor.

21. The heating unit according to claim 20, wherein the second control unit stops, when a predetermined condition is satisfied, a power supply to other power loads except for a part of power loads of the second control unit, and releases, when a predetermined condition is satisfied during a stop state of the power supply, the stop state.

22. The heating unit according to claim 21, further comprising a voltage sensor that detects a terminal voltage of the capacitor, wherein the second control unit compares the terminal voltage detected with a predetermined value, stops the power supply when the terminal voltage detected is above a predetermined value, and releases, when the terminal voltage detected is lower than the predetermined value during a stop state of the power supply, the stop state.

23. A fixing unit comprising:

a fixing member that applies pressure and heat to a medium, on which a toner image is formed, to fix the toner image on the medium;

a first heating member that produces heat with a supply of power from a commercial power supply, and heats the fixing member;

a capacitor;

a charger that charges the capacitor with a supply of power from the commercial power supply;

a second heating member that produces heat with a supply of power from the capacitor, and heats the fixing member;

a first control unit that stops, when a predetermined condition is satisfied, a power supply to other power loads except for a part of power loads of the heating unit, and releases, when the predetermined condition is satisfied during a stop state of the power supply, the stop state; and a second control unit that is driven with a supply of power independently from the first control unit, and controls charging of the capacitor.

24. The fixing unit according to claim 23, wherein the second control unit stops, when a predetermined condition is satisfied, a power supply to other power loads except for a part of power loads of the second control unit, and releases, when a predetermined condition is satisfied during a stop state of the power supply, the stop state.

25. The fixing unit according to claim 24, further comprising a voltage sensor that detects a terminal voltage of the capacitor, wherein the second control unit compares the terminal voltage detected with a predetermined value, stops the power supply when the terminal voltage detected is above a predetermined value, and releases, when the terminal voltage detected is lower than the predetermined value during a stop state of the power supply, the stop state.

26. An image forming apparatus that forms an image on a medium using an electrophotographic method, the image forming apparatus comprising a fixing unit that includes a fixing member that applies pressure and heat to a medium, on which a toner image is formed, to fix the toner image on the medium;

a first heating member that produces heat with a supply of power from a commercial power supply, and heats the fixing member;

a capacitor;

a charger that charges the capacitor with a supply of power from the commercial power supply;

a second heating member that produces heat with a supply of power from the capacitor, and heats the fixing member;

a first control unit that stops, when a predetermined condition is satisfied, a power supply to other power loads except for a part of power loads of the heating unit, and releases, when the predetermined condition is satisfied during a stop state of the power supply, the stop state; and a second control unit that is driven with a supply of power independently from the first control unit, and controls charging of the capacitor.

27. An auxiliary power unit comprising:

a first capacitor;

a first charger that charges the first capacitor with a supply of power from the commercial power supply;

a first terminal-voltage detection circuit that detects a terminal voltage of the first capacitor;

a second capacitor serially connected to the first capacitor;

a second charger that charges the second capacitor with a supply of power from the commercial power supply;

a second terminal-voltage detection circuit that detects a terminal voltage of the second capacitor; and a control unit that switches a charging operation between the first charger and the second charger so that the terminal voltage reaches a final target voltage based on results of detection by the first terminal-voltage detection circuit and the second terminal-voltage detection circuit.

28. The auxiliary power unit according to claim 27, wherein the control unit switches the charging operation between the first charger and the second charger in such a manner that the charging operation is performed alternately.

29. The auxiliary power unit according to claim 28, wherein the control unit allows either of the first charger and the second charger to start a charging operation, of which an initial terminal voltage detected upon a start of the charging operation is lower.

30. The auxiliary power unit according to claim 28, wherein the control unit switches the charging operation between the first charger and the second charger in such a manner that one of the terminal voltages detected alternately exceeds other of the terminal voltages.

31. The auxiliary power unit according to claim 30, wherein the one of the terminal voltages detected alternately exceeds the other of the terminal voltages by a predetermined voltage value.

32. The auxiliary power unit according to claim 31, wherein each of the first capacitor and the second capacitor includes a plurality of capacitor cells serially connected to each other, and the predetermined voltage value is set to a value not more than a reverse breakdown voltage per a capacitor cell.

33. The auxiliary power unit according to claim 27, wherein the control unit switches the charging operation between the first charger and the second charger in such a manner that the charging operation is performed alternately in a time basis from a start the charging operation until a temporary target voltage that is lower than the final target voltage is reached.

34. A fixing unit comprising:

a fixing member that applies pressure and heat to a medium, on which a toner image is formed, to fix the toner image on the medium;

first heating member that produces heat with a supply of power from a commercial power supply, and heats the fixing member; and a second heating member that produces heat with a supply of power from a first capacitor and a second capacitor in an auxiliary power unit, wherein the auxiliary power unit includes the first capacitor;

a first charger that charges the first capacitor with a supply of power from the commercial power supply;

a first terminal-voltage detection circuit that detects a terminal voltage of the first capacitor;

the second capacitor serially connected to the first capacitor;

a second charger that charges the second capacitor with a supply of power from the commercial power supply;

a second terminal-voltage detection circuit that detects a terminal voltage of the second capacitor; and a control unit that switches a charging operation between the first charger and the second charger so that the terminal voltage reaches a final target voltage based on results of detection by the first terminal-voltage detection circuit and the second terminal-voltage detection circuit.

35. An image forming apparatus that forms an image on a medium using an electrophotographic method, the image forming apparatus comprising a fixing unit that includes a fixing member that applies pressure and heat to a medium, on which a toner image is formed, to fix the toner image on the medium;

first heating member that produces heat with a supply of power from a commercial power supply, and heats the fixing member; and a second heating member that produces heat with a supply of power from a first capacitor and a second capacitor in an auxiliary power unit, wherein the auxiliary power unit includes the first capacitor;

a first charger that charges the first capacitor with a supply of power from the commercial power supply;

a first terminal-voltage detection circuit that detects a terminal voltage of the first capacitor;

the second capacitor serially connected to the first capacitor;

a second charger that charges the second capacitor with a supply of power from the commercial power supply;

a second terminal-voltage detection circuit that detects a terminal voltage of the second capacitor; and a control unit that switches a charging operation between the first charger and the second charger so that the terminal voltage reaches a final target voltage based on results of detection by the first terminal-voltage detection circuit and the second terminal-voltage detection circuit.

36. The image forming apparatus according to claim 35, further comprising:

a power controller that stops, when a predetermined condition is satisfied, a power supply to a part of power loads as a power saving mode, and releases, when the predetermined condition is satisfied during a stop state of the power supply, the stop state, wherein the control unit controls a charging operation, in such a manner that the first charger and the second charger are operated simultaneously in the power saving mode, and in such a manner that the first charger and the second charger are operated alternately in any mode other than the power saving mode.

* * * * *